US006821320B1

(12) United States Patent
Miyazaki

(10) Patent No.: US 6,821,320 B1
(45) Date of Patent: Nov. 23, 2004

(54) DUST COLLECTOR FOR COLLECTING FINE DUST IN AIR

(75) Inventor: Takao Miyazaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 40 days.

(21) Appl. No.: 10/295,828

(22) Filed: Nov. 18, 2002

(30) Foreign Application Priority Data

Nov. 16, 2001 (JP) ..... 2001-352137

(51) Int. Cl.[7] ..... B03C 3/30
(52) U.S. Cl. ..... 96/17; 96/29; 96/94
(58) Field of Search ..... 96/17, 29, 94

(56) References Cited

U.S. PATENT DOCUMENTS

| | | | | | |
|---|---|---|---|---|---|
| 2,184,732 | A | * | 12/1939 | Brewer | 96/17 |
| 2,282,770 | A | * | 5/1942 | Sarver | 96/17 |
| 3,105,750 | A | * | 10/1963 | Kayko et al. | 96/17 |
| 3,421,216 | A | * | 1/1969 | Anna | 30/41 |
| 3,493,109 | A | * | 2/1970 | Carta et al. | 209/11 |
| 3,616,604 | A | * | 11/1971 | Schouw | 96/17 |
| 3,982,043 | A | * | 9/1976 | Simpson | 430/121 |
| 4,378,980 | A | * | 4/1983 | Long | 96/17 |
| 5,681,374 | A | * | 10/1997 | Von Glehn | 96/16 |
| 5,885,330 | A | * | 3/1999 | Lee | 95/69 |
| 5,888,274 | A | * | 3/1999 | Frederick | 95/59 |
| 6,090,189 | A | * | 7/2000 | Wikstrom et al. | 96/69 |
| 6,193,788 | B1 | | 2/2001 | Nojima | 96/97 |

FOREIGN PATENT DOCUMENTS

| | | | | |
|---|---|---|---|---|
| JP | 4-171065 | * | 6/1992 | 96/17 |
| JP | 6-103745 | A | 4/1994 | |
| JP | 10-323580 | A | 12/1998 | |

* cited by examiner

*Primary Examiner*—Richard L. Chiesa
(74) *Attorney, Agent, or Firm*—Sughrue Mion, PLLC

(57) ABSTRACT

A dust collector for collecting fine dust in air and for cleaning the air is provided. A first friction disk is produced from a first substance. A second friction disk is produced from a second substance that is chargeable triboelectrically in a polarity different from a polarity of the first substance. The first and second friction disks frictionally contact one another. The second friction disk moves relative to the first friction disk, to generate electrostatic charge and thereby attract fine dust.

27 Claims, 15 Drawing Sheets

DUST COLLECTOR FOR COLLECTING FINE DUST IN AIR

BACKGROUND OF THE INVENTION

1. Field of the Invention

The present invention relates to a dust collector for collecting fine dust in air. More particularly, the present invention relates to a dust collector for collecting fine dust in air, which is used with an air supply assembly for supplying the air through a duct, and can efficiently collect dust or fine particles to clean the 2. Description Related to the Prior Art There are various types of dust collectors, of which an example is disclosed in U.S. Pat. No. 6,193,788 (corresponding to JP-A 10-249235). A plurality of needle electrodes charges floating fine particles in air by causing corona discharge in the periphery of their needle ends. A plurality of cell-shaped collecting electrodes attract and collect the particles electrostatically after charging by the needle electrodes.

JP-A 10-323580 discloses a frictional electrification device in which objects are charged at an amount required for classifying target crushed trash including plastic material. The frictional electrification device includes an outer container, and an inner container disposed in the outer container in a rotatable and vibratile manner. An agitation blade is disposed in the inner container, for rotating in a direction backward to that of the inner container. When the inner container is supplied with the target crushed trash, the agitation blade mover the target crushed trash toward the trash exit port successively. Electric charge is generated by frictional contact of the inner container with the agitation blade in rotation and vibration, and also by frictional contact between pieces of the target crushed trash. According to a triboelectric series including related substances, the target crushed trash with particular characteristics is charged positively or negatively, and then is exited through a trash exit port. Note that the triboelectric series is a train of substances obtained in such a manner that, when two substances are combined as a pair and frictionally contacted by one another, one is charged positively, the remainder being charged negatively, and that numerous substances are arranged according to the electrically negative and positive characteristics after experiments.

However, the dust collector of the first of the two documents has shortcomings. Because a direct-current power source of high voltage is required, manual handling of the dust collector is dangerous to users. Also, a manufacturing cost is considerably high. Furthermore, the frictional electrification device of the second of the two documents has problems. Electric charge is generated nearly in entirety of the inside of the inner container by the charging operation. For the periodical maintenance after repeated use, large regions in the frictional electrification device should be cleaned, including an inner surface of the inner container and a surface of the agitation blade. However, no disassembly of the outer container of the inner container is disclosed in the document. To clean and maintain the frictional electrification device requires much time and laborious operation.

SUMMARY OF THE INVENTION

In view of the foregoing problems, an object of the present invention is to provide a dust collector for collecting fine dust in air, capable of collecting floating fine particles safely and also at a lost cost.

Another object of the present invention is to provide a dust collector for collecting fine dust in air, capable of being cleaned with great ease.

In order to achieve the above and other objects and advantages of this invention, a dust collector for collecting fine dust in air and for cleaning the air is provided. A first friction member is produced from a first substance. A second friction member is produced from a second substance that is chargeable triboelectrically in a polarity different from a polarity of the first substance. A friction driving mechanism moves one of the first and second friction members relative to a remaining one thereof, and frictionally generates electrostatic charge, to attract the fine dust.

In other words, a first friction device is produced from a first substance. A second friction device is produced from a second substance which is in a different position from the first substance in a triboelectric series of substances, for frictionally contacting the first friction device. A moving mechanism moves one of the first and second friction devices relative to a remaining one thereof, to generate electrostatic charge by charging the first and second friction devices, so as to attract the fine dust.

The first substance is polytetrafluoroethylene.

At least one of the first and second substances has a surface resistance of $10^9$ Ω or higher.

Furthermore, there is a passage case for flowing through of the air, the first and second friction devices contact one another inside the passage case. A fan sends the air through the passage case.

The first and second friction devices have a plate shape, the first friction device is stationary with the passage case. The moving mechanism moves the second friction device.

The first and second substances have such characteristics as to be charged respectively in negative and positive states when frictionally contacted on one another.

The fan sends the air from an air intake port of the passage case to an air, exhaust port thereof. Furthermore, a filter is disposed in the air intake, port, for preventing dust from entry therein.

The moving mechanism includes a motor for rotating the second friction device.

The first friction device is secured to a case panel of the passage case.

Furthermore, an access opening is formed in the passage case, and provided with the first friction device secured to an inside thereof. A fastener retains the first friction device in the access opening, the fastener being detached for cleaning or maintaining the first and second friction devices, to allow removal of the first friction device from the access opening.

Furthermore, one case panel in provided with the first friction device secured thereto, retained in the access opening by the fastener, for closing the access opening.

Furthermore, a biasing mechanism presses the second friction device against the first friction device.

The case panel is a lower panel of the passage case disposed on a downside.

In a preferred embodiment, the case panel comprises a lower panel and au upper panel of the passage case disposed on respectively a downside and upside. First and second electrostatic generator units are disposed in respectively the lower and upper panels, each of the first and second electrostatic generator units being constituted by the first and second friction devices.

Furthermore, first and second axial holes are formed through respectively the case panel and the first friction device. The motor is disposed outside the case panel, has an output shaft extending through the first and second axial holes, for rotating the second friction device.

The air is supplied to a thermal bead of a thermal printer by the fan through the passage case, to cool the thermal head.

The second friction device has a disk shape.

The second substance is polypropylene.

In another preferred embodiment, furthermore, a dust eliminating portion rubs away the fine dust stuck on the first or second friction device.

The moving mechanism includes a motor for rotating the second friction device. The dust eliminating portion is a dust eliminating edge portion of the second friction device, extending in a direction away from a rotational center thereof, for rubbing the first friction device in rotation of the second friction device, to eliminate the fine dust stuck on the first or second friction device.

The first and second friction devices are disposed in an upper panel of the passage case disposed on an upside. Furthermore, a dust exit path is formed in a downside of the passage case, for passing down the fine dust from the dust eliminating portion, to exit the fine dust.

Furthermore, a dust containing case is disposed under the dust exit path, for receiving the fine dust to be abandoned.

The passage case includes an intermediate casing frame, has the dust exit path, and in which the first and second friction devices contact one another. An upstream casing frame is connected with the intermediate casing frame on an upstream side, for containing the filter. A downstream casing frame is connected with the intermediate casing frame on a downstream side, for containing the fan.

The first friction device is the intermediate casing frame.

Furthermore, a first shutter openably closes a path of the air extending from the air intake port toward the air exhaust port. A second shutter closes the dust exit path openably. A controller opens and closes the first and second shutters alternately, drives the fan to eject the air from the passage case while the second shutter is closed and the first shutter is open, and drives the moving mechanism to attract the fine dust while the first shutter is closed and the second shutter is open.

The controller measures driving time of driving the moving mechanism, and when the driving time increases to become a predetermined time, stops driving the moving mechanism, and closes the second shutter.

The controller measures elapsed time elapsed after stopping driving the moving mechanism, and when the elapsed time increases to become a predetermined limit time, stops driving the fan, and closes the first shutter.

At a time of powering, the controller closes the first shutter, opens the second shutter, and also drives the moving mechanism to attract the fine dust.

A surface resistance of the intermediate casing frame is higher than a surface resistance of the upstream and downstream casing frames, and is $10^9$ Ω or higher.

In a further preferred embodiment, the second friction device has a peripheral edge of which at least one portion extends in a direction away from a rotational center thereof, and constitutes the dust eliminating edge portion.

In another preferred embodiment, the second friction device includes a rotatable plate or disk. At least one opening is formed in the plate or disk, has an inner edge portion including the dust eliminating edge portion.

The at least one opening is plural openings.

In still another preferred embodiment, the second friction device has at least one arm disposed to extend in a direction away from a rotational center thereof, the arm having the dust eliminating edge portion.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
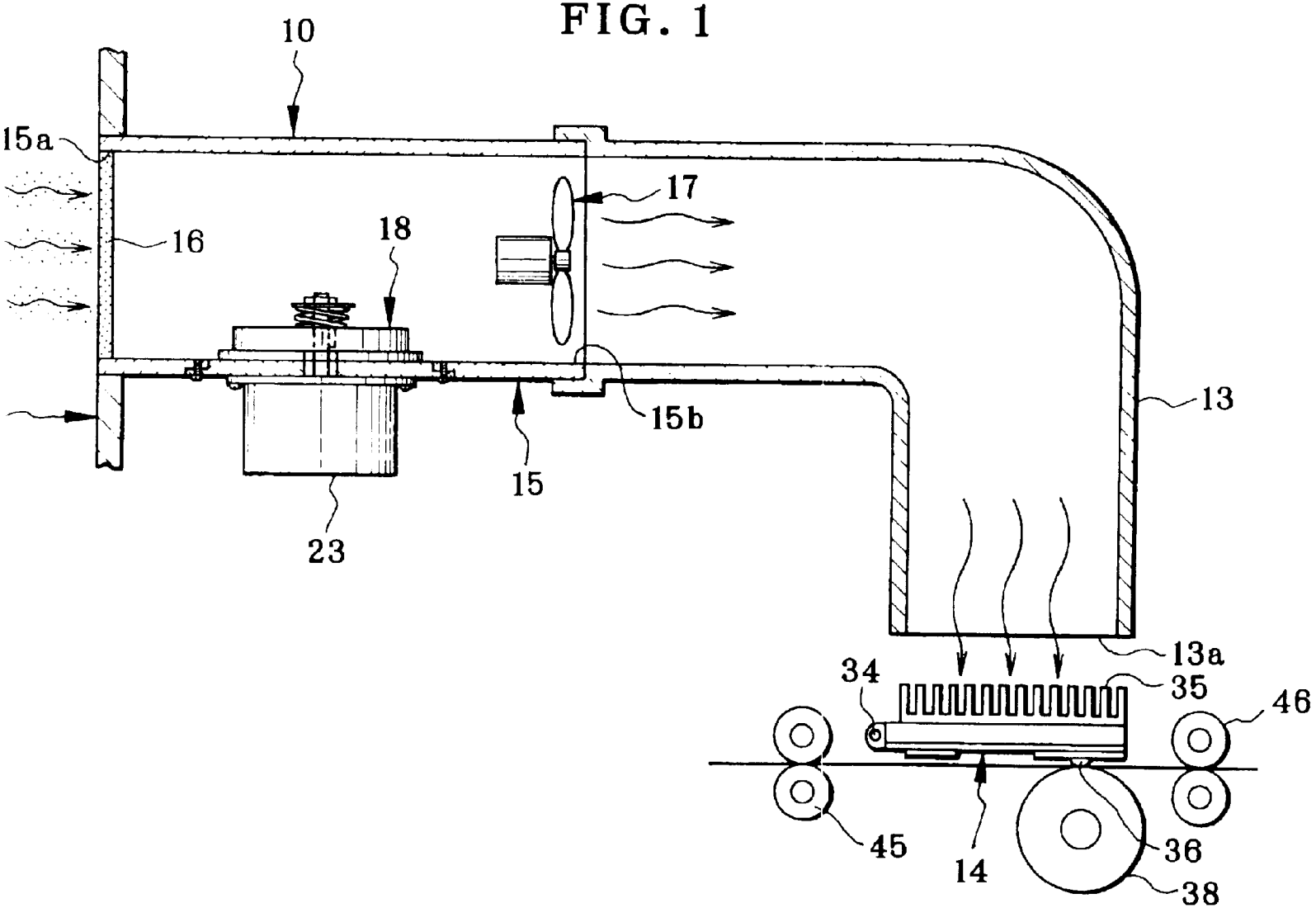
FIG. 1 is a vertical section, illustrating a dust collector of the invention in combination with a thermal head.

In FIG. 1, a dust collector 10 for use with a thermal printer 11 is depicted. The thermal printer 11 includes a thermal head 14 and a lateral panel 12. The dust collector 10 is fitted in an opening 12*a* formed in the lateral panel 12, and secured to the thermal printer 11. A duct 13 is connected with the dust collector 10, to cool the thermal head 14 by sending cooling air from the dust collector 10. To keep cooling air free from dust, the dust collector 10, or air cleaner of dust collecting type is incorporated in a cooling air supply device for the thermal head 14.

Figure 2:
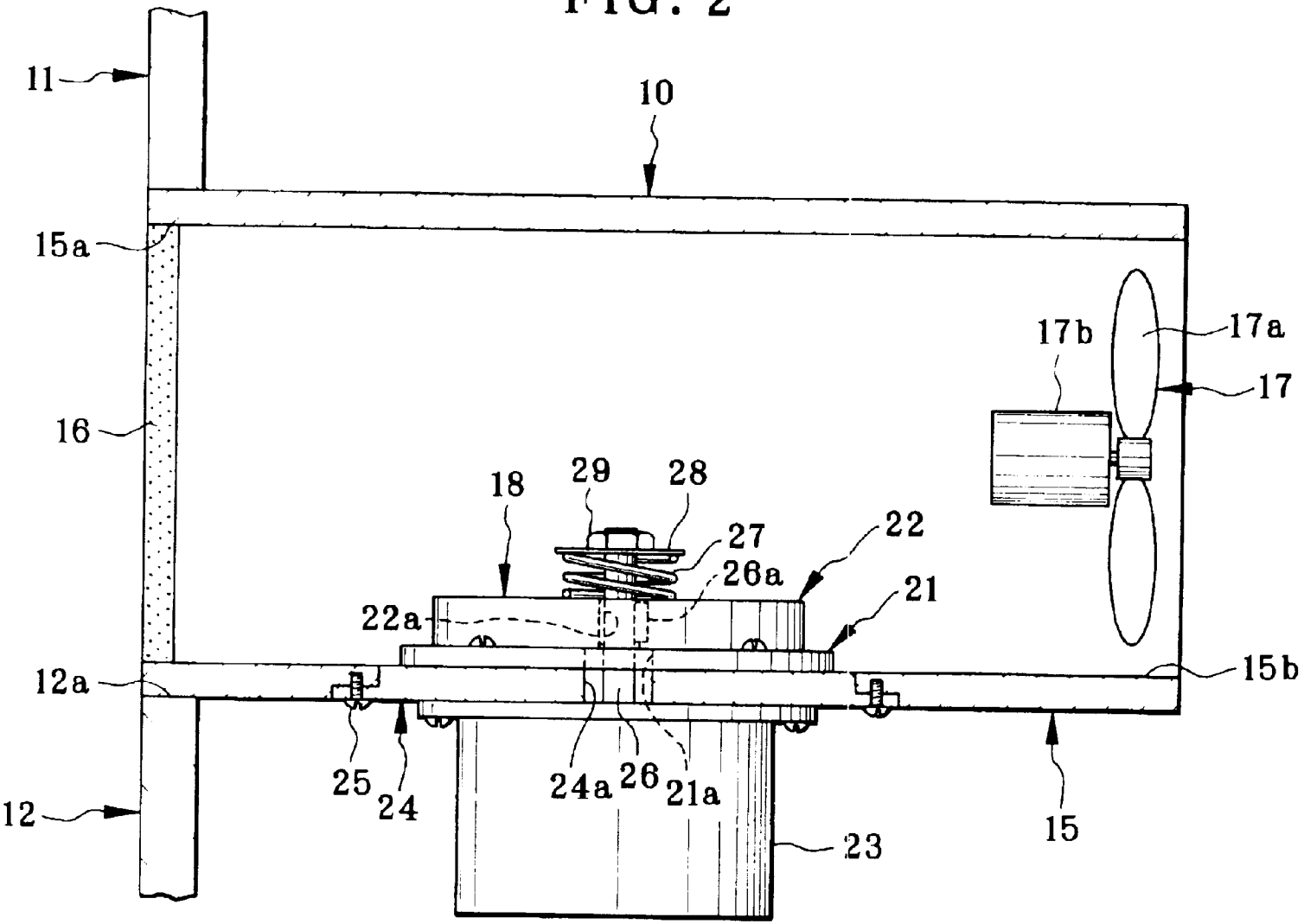
FIG. 2 is a vertical section illustrating the dust collector.

In FIG. 2, the dust collector 10 includes a passage case 15, a filter 16, a fan 17 and an electrostatic generator unit 18. In the passage case 15 are formed an air intake port 15*a* and an air exhaust port 15*b*. The passage case 15 has a shape of a rectangular parallelepipedon. The filter 16 is formed from polyurethane foam, and fitted in the air intake port 15*a*. The fan 17 is disposed near to the air exhaust port 15*b*. The electrostatic generator unit 18 is secured to a panel of the passage case 15 between the air intake port 15*a* and the air exhaust port 15*b*.

The filter 16, instead of using the polyurethane foam, may be a HEPA filter (high efficiency particulate air filter) or an ULPA filter (ultra low penetration air filter). The fan 17 includes a propeller or blades 17*a* and a motor 17*b* for rotating the propeller 17*a*.

The electrostatic generator unit 18 includes a first friction disk 21, a second friction disk 22, a motor 23 and a case panel 24. The first friction disk 21 as first friction device is formed from polytetrafluoroethylene or Teflon (trade name). The second friction disk 22 as second friction device is formed from polypropylene, and frictionally contacts the first friction disk 21. The motor 23 as moving mechanism rotates the second friction disk 22. The case panel 24 or lid panel supports the first friction disk 21 and the motor 23 in a fixed manner. An access opening 15*c* is formed in the passage case 15, and receives the case panel 24 fitted therein. Four fastening screws 25 as fastener are used to fix the case panel 24 to the access opening 15*c*. When the fastening screws 25 are unfastened, the electrostatic generator unit 18 is removed from the passage case 15, for a user to clean the first and second friction disks 21 and 22 with great ease by separating the electrostatic generator unit 18 from the passage case 15.

Figure 3:
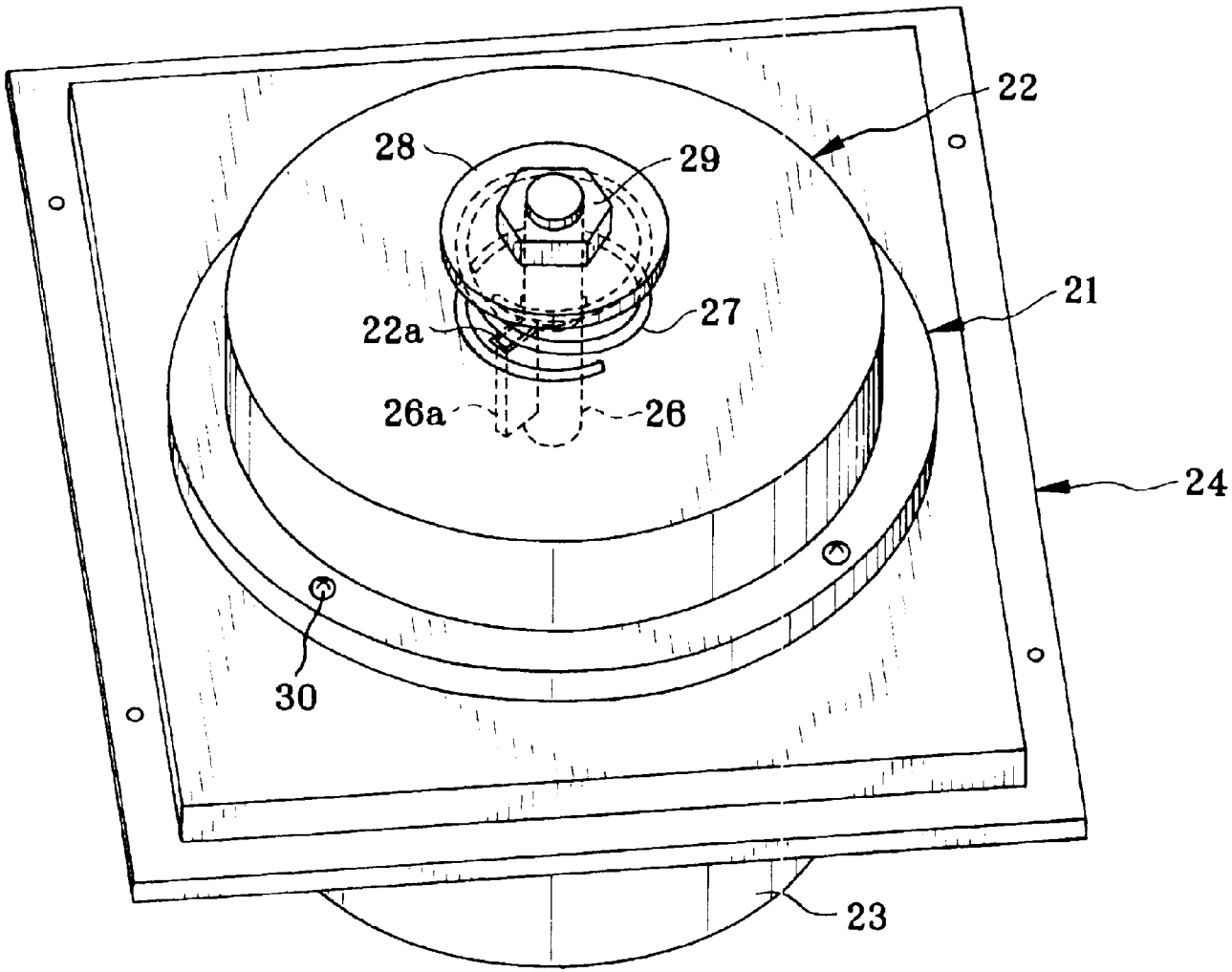
FIG. 3 is a perspective illustrating an electrostatic generator unit.

Axial holes 21*a* and 24*a* are formed in respectively the first friction disk 21 and the case panel 24. A motor output shaft 26 or transmission shaft of the motor 23 is loosely inserted in the axial holes 21*a* and 24*a*. An engaging key 26*a* projects from a middle portion of the motor output abaft 26. A key way 22*a* is formed in the second friction disk 22, becomes engaged with the engaging key 26*a*. When the motor output shaft 26 rotates, the second friction disk 22 also rotates, In FIG. 3, a biasing coil spring 27 as biasing mechanism is positioned at and received by the motor output shaft 26 which projects from an upper surface of the second friction disk 22. The coil spring 27 presses the second friction disk 22 against the first friction disk 21. A flange ring 28 or washer is disposed at an upper end of the motor output shaft 26, contacts the coil spring 27 and pushes the coil spring 27 downwards. A nut 29 is secured to the motor output shaft 26, and keeps the flange ring 28 in the position. The firmness of fastening the nut 29 can be adjusted to change the force applied by the coil spring 27 between the second friction disk 22 and the first friction disk 21. Note that four screws 30 fix the first friction disk 21 to the case panel 24.

Figure 4:
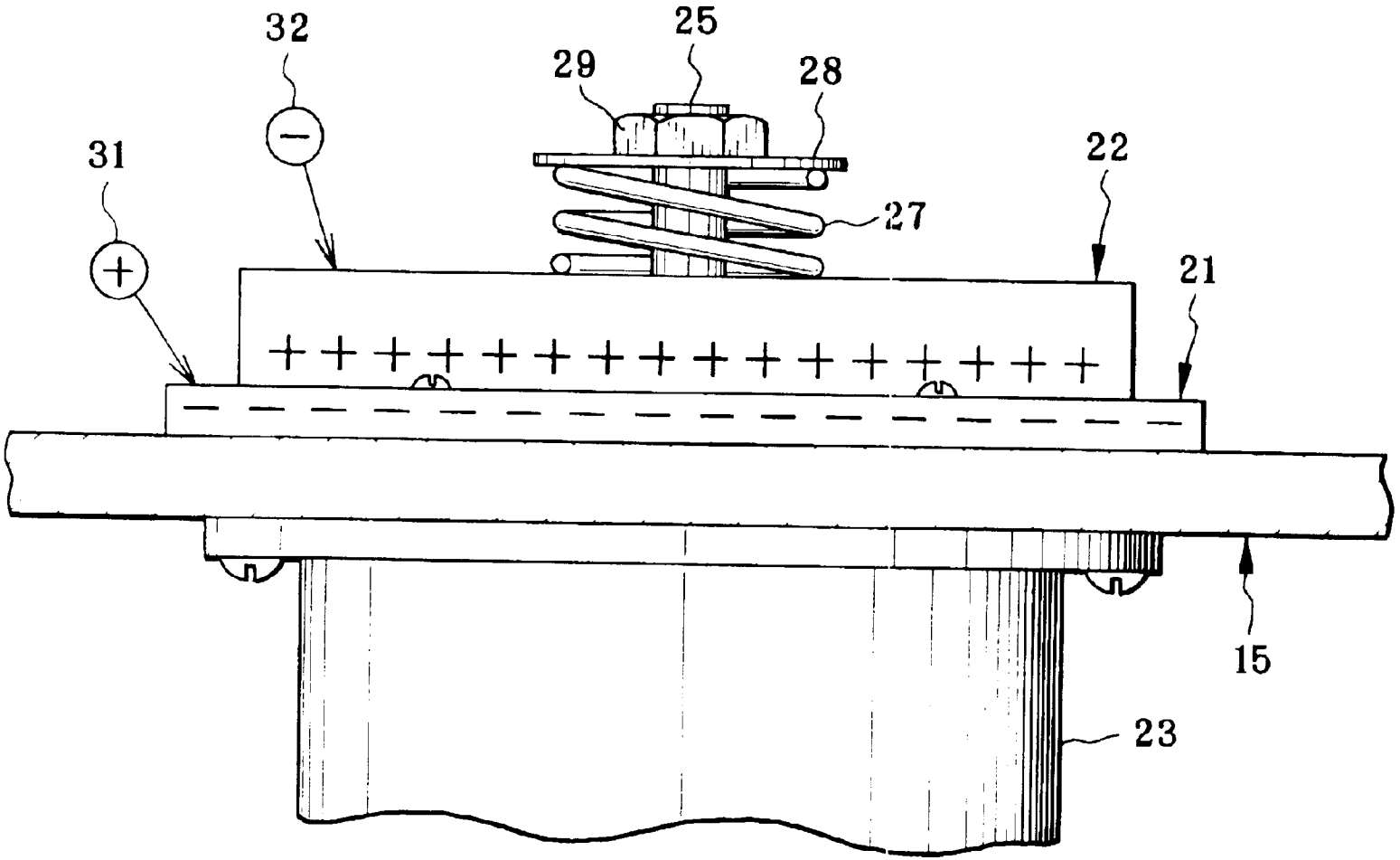
FIG. 4 is an explanatory view illustrating a charged state of the electrostatic generator unit.

When the motor 23 is driven to rotate the motor output shaft 26, the second friction disk 22 rotates. A lower surface of the second friction disk 22 frictionally contacts and rubs an upper surface of the first friction disk 21. As the first friction disk 21 is Teflon and the second friction disk 22 is polypropylene, the first friction disk 21 is charged negatively, and the second friction disk 22 is charged positively. This is according to the characteristics of the substances as indicated in the triboelectric series described herein. In FIG. 4, positively charged floating fine particles 31 as dust are attracted by the first friction disk 21. Negatively charged floating fine particles 32 as dust are attracted by the second friction disk 22. Note that the triboelectric series is a train of substances. When two substances are combined as a pair and frictionally contacted by one another, one is charged positively, the remainder being charged negatively. Various substances are arranged in one series according to the positive and negative states when charged by friction. An effect of charging by frictional contact of two substances in the triboelectric series is lower according to closeness between those in the triboelectric series, and is higher according to a distance between those in the triboelectric series.

The triboelectric series, from the positive side (+) to the negative side (−); Asbestos-Human hair, animal fur Class-Wool-Nylon-Rayon-Lead-Silk-Cotton Hemp-Wood-Human skin-Acetate-Aluminum-Paper-Steel-Copper-Nickel-Rubber-Polypropylene-Polyester-Acrylic material-Polyurethane-Polyethylene-Polyvinyl chloride-KEL-F (trade name of polychloro trifluoro ethylene)-Teflon (trade name).

Figure 5:
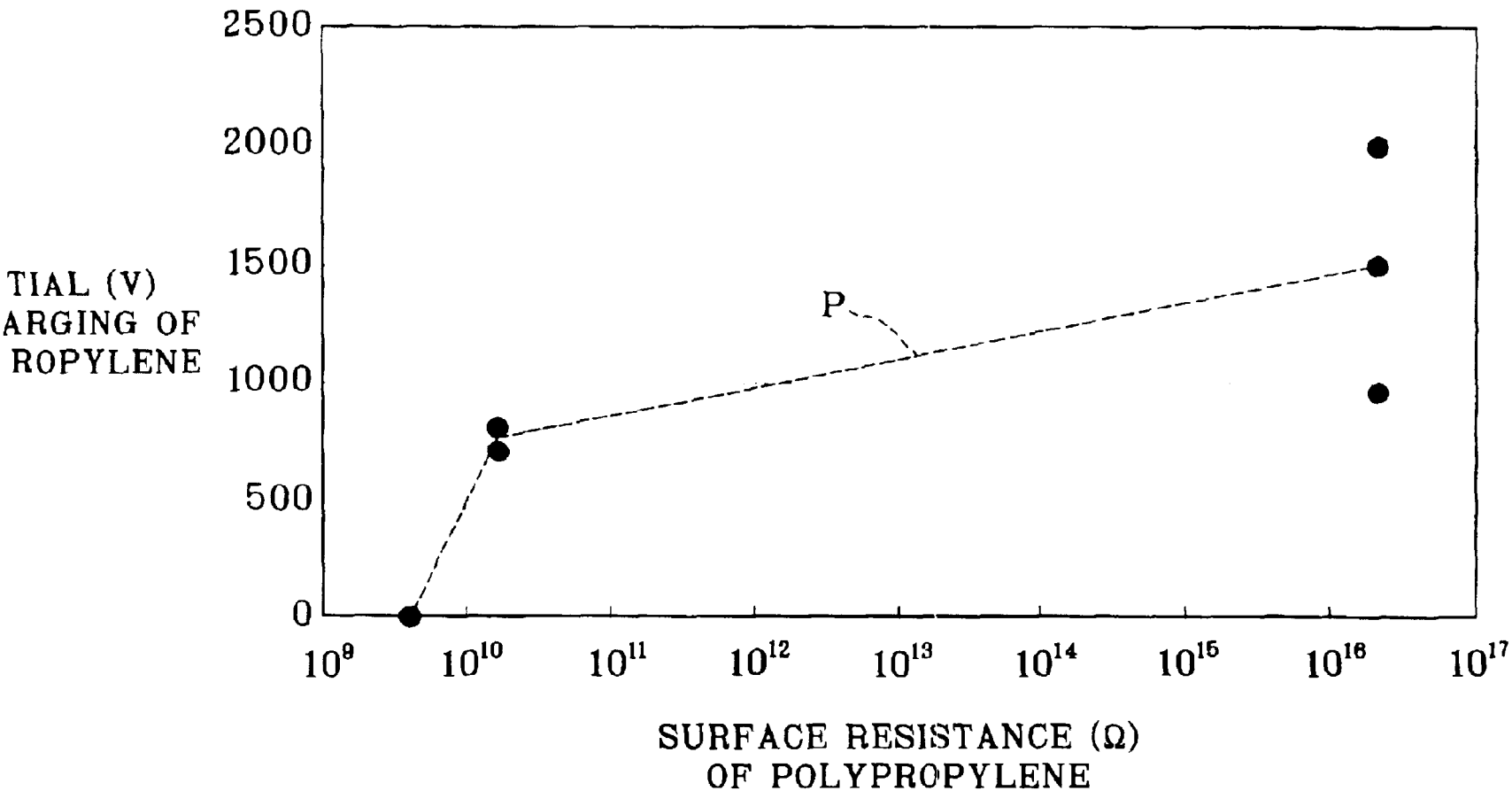
FIG. 5 is a graph illustrating a relationship between a potential (V) of charging and surface resistance (Ω) of polypropylene or the second friction disk.

The dust collector 10 starts operation experimentally. When three minutes lapses after the start, a potential (V) of charging and the surface resistance (Ω) of polypropylene are measured. In FIG. 5, a relationship between those two is illustrated. If the surface resistance of the polypropylene is $10^9$ Ω or less, the potential is zero. No collection of dust can be effected. It is necessary that at least one of the two substances should have a surface resistance of $10^9$ Ω or more for ensuring sufficient potential of charging for the purpose of performance of the dust collection. Note that plural values of the potential were obtained for each one value of the surface resistance. This shows occurrence of deviations in the results of the experiment. In FIG. 5, a broken line P indicates an average of the potential values.

Figure 6:
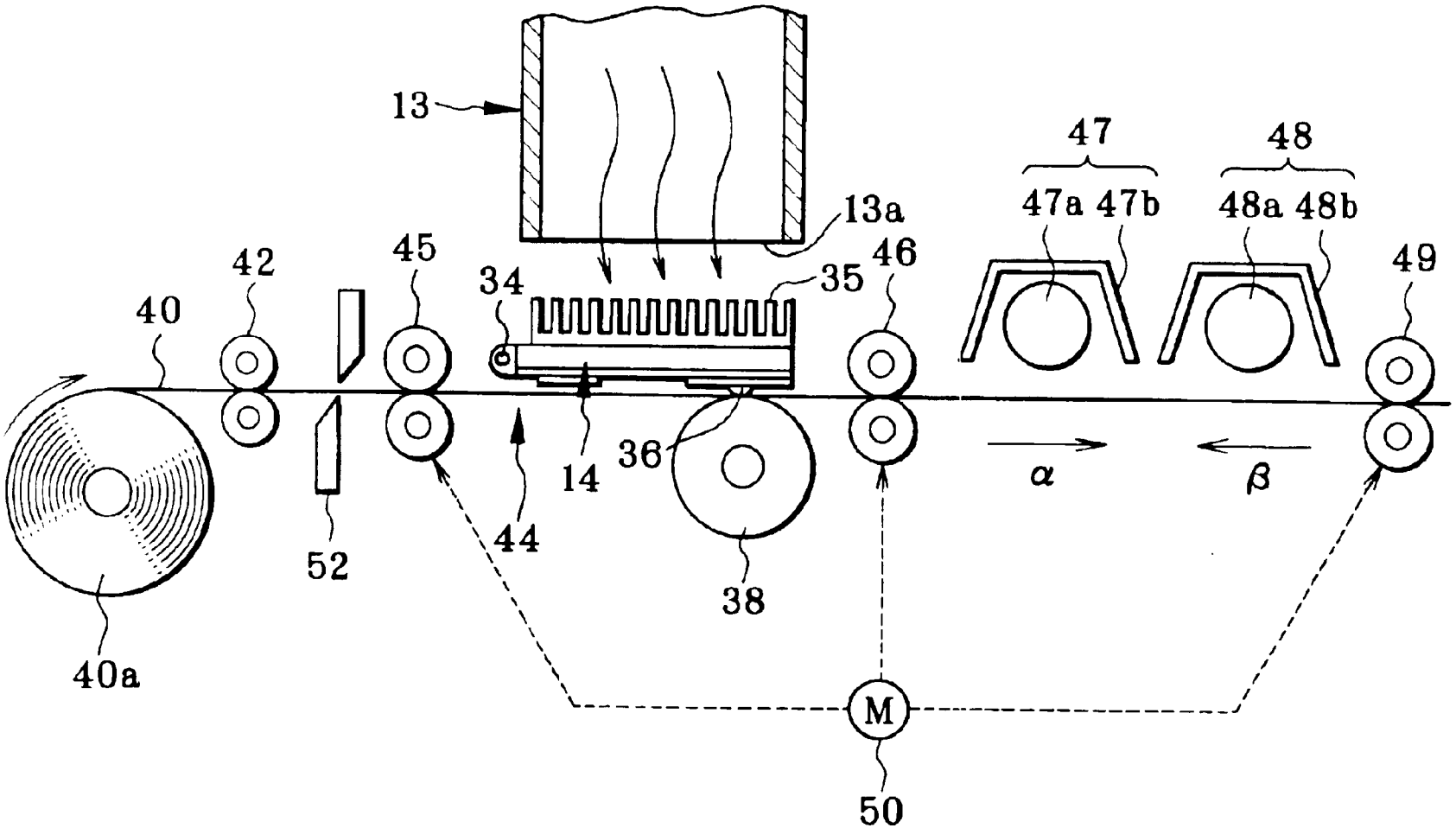
FIG. 6 is an explanatory view illustrating the thermal printer.

In FIG. 6, main portions of the thermal printer 11 is depicted. A duct exhaust port 13*a* is included in the duct 13. A pivot 34 of the thermal head 14 keeps the thermal head 14 rotatable under the duct exhaust port 13*a*. A heat sink assembly 35 of aluminum is secured to a top of the thermal head 14, and receives cooling air which is supplied through the duct exhaust port 13*a*.

A heating element array 36 is incorporated in the thermal head 14, and positioned opposite to the heat sink assembly 35. As is well-known in the art, the heating element array 36 includes a great number of heating elements arranged in line perpendicular to the drawing sheet of FIG. 6. A platen roller 38 is disposed under the heating element array 36 and opposed thereto. Color thermosensitive recording material 40 is squeezed between the platen roller 38 and the heating element array 36. A full-color image is recorded to the recording material 40 while the recording material 40 is fed.

The recording material 40 includes a support, plural coloring layers and a transparent protective layer. The support is formed from paper or the like. The coloring layers are overlaid on one another, and develop colors of respectively cyan, magenta and yellow, Among the coloring layers, the cyan coloring layer has the lowest heat sensitivity, and develops the cyan color if relatively high heat energy is applied to it. The magenta coloring layer has a medium heat sensitivity. The yellow coloring layer has the highest heat sensitivity, and develops the yellow color if relatively low-heat energy to applied to it.

The yellow and magenta coloring layers have characteristics of fixability in response to electromagnetic rays. Before the magenta recording, the yellow coloring layer is fixed to prevent further development of yellow by destroying coloring ability of a remaining yellow coloring component. Before the cyan recording, the magenta coloring layer is fixed to prevent further development of magenta by destroying coloring ability of a remaining magenta coloring component. To be precise, the magenta coloring layer has the maximum absorption wavelength of approximately 365 nm, so its coloring ability is destroyed when ultraviolet rays peaking at this wavelength is applied to it. The yellow coloring layer has the maximum absorption wavelength of approximately 420 nm, so its coloring ability is destroyed when visible violet rays peaking at this wavelength is applied to it.

A material roll 40*a* is constituted by the recording material 40 in a continuous form wound in a roll form. A supply roller set 42 unwinds the recording material 40 from the material roll 40*a*. A feeding path 44 in a straight form is supplied with the recording material 40 by the supply roller set 42. A feeder roller set 45 nips the recording material 40, and sends the recording material 40 to a printing station where the thermal head 14 and the platen roller 38 operate.

A feeder roller set 46 is disposed in the vicinity of the platen roller 38. There are a yellow photo fixer 47 and a magenta photo fixer 48 for electromagnetically fixing the recording material 40 after the thermal recording. An ejection roller set 49 is also disposed for feeding the recording material 40 toward a receptacle tray (not shown) after the fixation.

The yellow photo fixer 47 includes an ultraviolet lamp 47*a* and a reflector 47*b*. The ultraviolet lamp 47*a* has a tubular shape, and emits near ultraviolet rays of which a peak of emission is at a wavelength of approximately 420 nm. The magenta photo fixer 48 includes an ultraviolet lamp 48*a* and a reflector 48*b*. The ultraviolet lamp 48*a* has a tubular shape, and emits near ultraviolet rays of which a peak of emission is at a wavelength of approximately 365 nm.

A feeder motor 50 drives the feeder roller sets 45 and 46 and the ejection roller set 49 to transport the recording material 40 in an advancing direction at and a returning direction β. The recording material 40 is fed back and forth along the feeding path 44 by the feeder roller sets 45 and 46 and the ejection roller set 49. The thermal head 14 records yellow, magenta and cyan images to the recording material 40 during the feeding according to the frame-sequential full-color recording. A cutter 52 is disposed between the supply roller set 42 and the feeder roller set 45, and cuts the recording material 40 at the predetermined size into a sheet, which is then ejected. Note that, although the recording material 40 has a continuous form with a great length, it is possible to use recording sheets prepared in a regular size.

The operation of the thermal printer 11 is described. When the thermal printer 11 is initially powered, the motors 17*b* and 23 in the dust collector 10 start rotation. The propeller 17*a* is rotated by the motor 17*b*. So external air is let in the passage case 15 of the dust collector 10 through the filter 16 in the air intake port 15*a*. At this time, the filter 16 removes dust or particles of a middle or great size from the air.

The motor 23 rotates the second friction disk 22, and rubs it on the first friction disk 21. The first friction disk 21 is charged negatively. The second friction disk 22 is charged positively. Among particles as dust flowing in the air taken in the air intake port 15*a*, the positively charged floating fine particles 31 are attracted by the first friction disk 21. The negatively charged floating fine particles 32 are attracted by the second friction disk 22. The cleaned air is ejected through the air exhaust port 15*b*, sent through the duct 13 toward the heat sink assembly 35 of the thermal head 14. Thus, the thermal head 14 is cooled.

When a printing command signal is input to the thermal printer 11, the feeder motor 50 starts being rotated in a forward direction. The recording material 40 nipped by the supply roller set 42 is supplied into the feeding path. A front end of the recording material 40 is detected, to start counting to measure a feeding amount of the recording material 40.

The recording material 40 is fed by the feeder roller set 45 and moved past the thermal head 14. When a front end of the recording material 40 becomes nipped by the feeder roller set 46, the recording material 40 is stopped. A shifting mechanism shifts the thermal head 14, to press the heating element array 36 against the recording material 40. The feeder motor 50 rotates forwards, to transport the recording material 40 in the advancing direction. When the beginning position of a recording region reaches the thermal head 14, yellow recording is started.

Yellow image data is subjected to image processing for color compensation, gradation correction and the like, and converted to a signal of driving voltage levels according to gradation levels of pixels. These driving voltage levels are combined with a driving voltage level for bias heating constant for the yellow. Thus, the heating elements in the heating element array 36 are driven. Thus, the yellow coloring layer in the recording material 40 is heated to print a yellow image one line after another.

Upon the start of the yellow recording, the ultraviolet lamp 47*a* in the yellow photo fixer 47 is turned on. When the recording material 40 reaches the yellow photo fixer 47, ultraviolet rays are applied to the recording material 40, to fix the yellow coloring layer electromagnetically. When the fixation is completed, the shifting mechanism shifts the thermal head 14, to move the heating element array 36 away from the recording material 40. The feeder motor 50 is caused to rotate backwards, to transport the recording material 40 in the returning direction, Also, the ultraviolet lamp 47*a* is turned off. When the recording material 40 is wound back, a beginning position of a recording region of the recording material 40 reaches the thermal head 14. The feeder motor 50 is stopped. The heating element array 36 is pressed against the recording material 40. Rotation of the feeder motor 50 is changed over to the forward rotation. Also, magenta image data is converted to driving voltage levels according to magenta gradation levels of the respective pixels. These driving voltage levels are combined with a driving voltage level for bias heating constant for the magenta. Thus, the heating elements in the heating element array 36 are driven.

Upon the start of the magenta recording, the ultraviolet lamp 48*a* in the magenta photo fixer 48 is turned on. When the recording material 40 reaches the magenta photo fixer 48, ultraviolet rays are applied to the recording material 40, to fix the magenta coloring layer electromagnetically. When the fixation is completed, the heating element array 36 is moved away from the recording material 40. The feeder motor 50 is caused to rotate backwards, to transport the recording material 40 in the returning direction.

When the recording material 40 is wound back, the beginning position of the recording region of the recording material 40 reaches the thermal head 14. The feeder motor 50 is stopped. The heating element array 36 is pressed against the recording material 40. Rotation of the feeder motor 50 is changed over to the forward rotation. Also, cyan image data is converted to driving voltage levels according to cyan gradation levels of the respective pixels. These driving voltage levels are combined with a driving voltage level for bias heating constant for the cyan. Thus, the heating elements in the heating element array 36 are driven.

When the cyan recording is completed, the recording material 40 is fed further in the advancing direction. The cutter 52 cuts the recording material 40 to obtain a sheet as a print, which is ejected externally to the tray disposed outside the thermal printer 11.

Even at the initial time of powering the printer, the heat sink assembly 35 of the thermal head 14 is supplied with clean air by the duct 13. The thermal head 14 can be prevented from being overheated. Heat energy of exact levels can be applied to the recording material 40 for each of the yellow, magenta and cyan colors. A full-color image can be printed with high quality by reliably reproducing the gradation.

If the electrostatic generator unit 18 is used for a long time, dust is stuck on the first and second friction disks 21 and 22. So the dust collector 10 is cleaned periodically, one time per a month. For the purpose of cleaning, the fastening screws 25 are unfastened to remove the electrostatic generator unit 18 from the passage case 15. The nut 29 is detached from the motor output shaft 26, to separate the second friction disk 22 from the first friction disk 21. Therefore, the first and second friction disks 21 and 22 can be cleaned easily and reliably. Furthermore, the screws 30 may be unfastened, so that the first friction disk 21 can be removed from the case panel 24 and can be cleaned alone. Should the first and second friction disks 21 and 22 be polluted with dirt to an irrecoverable extent, or be scratched or damaged after long use, the first and second friction disks 21 and 22 are replaced with unused disks.

Figure 7:
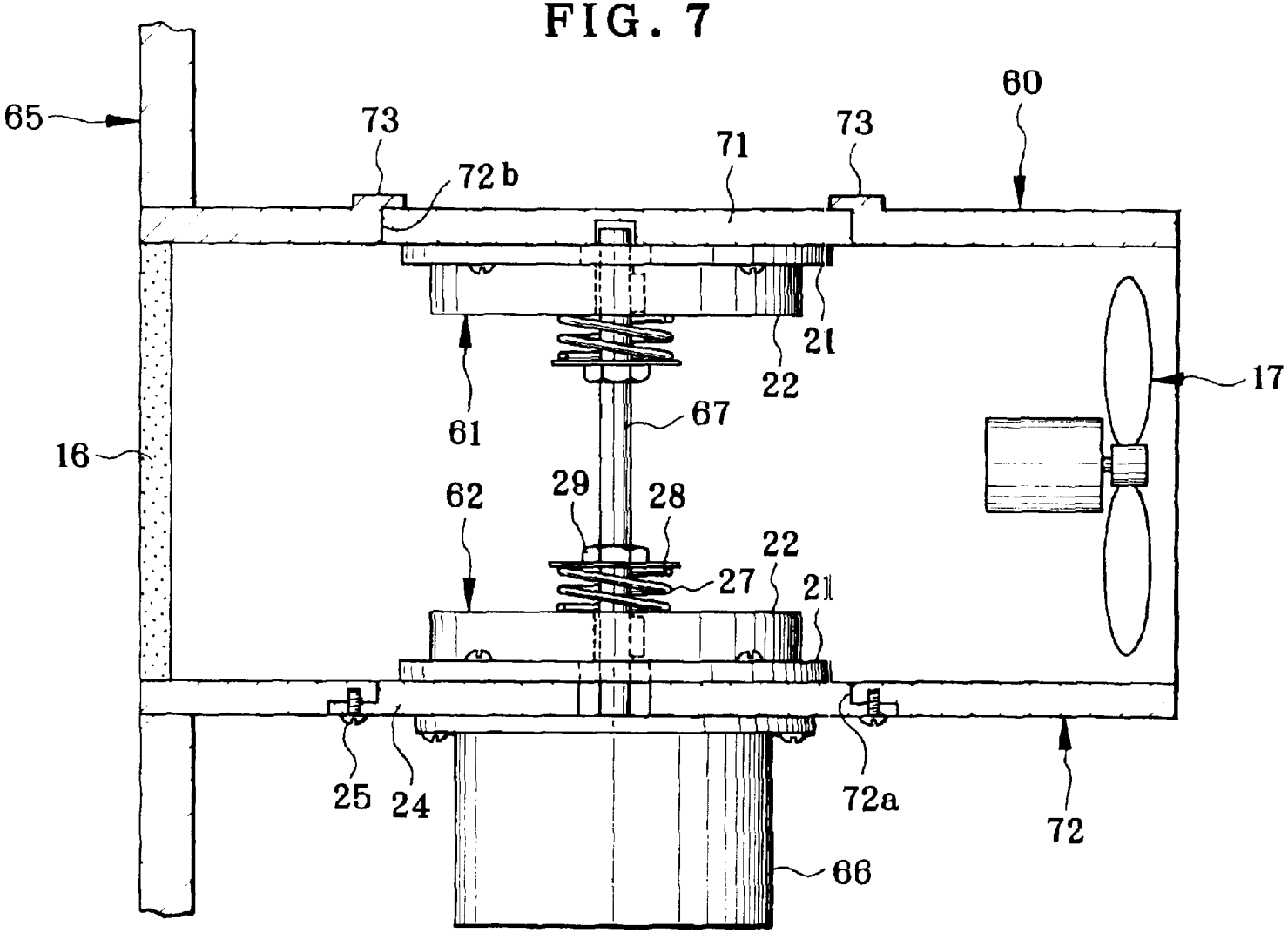
FIG. 7 is a vertical section illustrating another preferred dust collector including two electrostatic generator units.

In FIG. 7, a second preferred embodiment is illustrated. A dust collector 60 for use with a thermal printer 65 includes two electrostatic generator units 61 and 62 arranged vertically. This construction makes it possible to heighten efficiency by two times as high as that of the initial embodiment. The air can become still cleaner before the supply into a thermal printer 65. Elements similar to those of the above embodiment are designated with identical reference numerals.

In a manner similar to the above embodiment, the electrostatic generator units 61 and 62 have the second friction disk 22 which is pressed against the first friction disk 21 by the coil spring 27. When the second friction disk 22 rotates, the first friction disk 21 is rubbed by the second friction disk 22 with high friction. One motor 66 as moving mechanism is disposed on a side of the electrostatic generator unit 62. An output shaft 67 of the motor 66 extends to the electrostatic generator unit 61, is engaged with the second friction disk 22 in the electrostatic generator unit 61, and rotates the second friction disk 22 in each of the electrostatic generator units 61 and 62.

A passage case 72 of the dust collector 60 includes a case panel or lid panel 71 and an access opening 72*a*. The first friction disk 21 of the electrostatic generator unit 61 is attached to the case panel 71. The access opening 72*a* receives the case panel 24 fitted therein fixedly, and has a larger size than the case panel 71. If a user wishes to clean the first and second friction disks 21 and 22, the combination of the electrostatic generator units 61 and 62 can be removed through the access opening 72*a* by means of the output shaft 67 connecting the two units. Also, the passage case 72 includes an access opening 72*b* and a stopper 73. The access opening 72*b* receives insertion of the case panel 71. The stopper 73 is formed with an outer edge of the access opening 72*b*, and regulate a position of the output shaft 67 in an axial direction that is vertical in the drawing.

Figure 8:
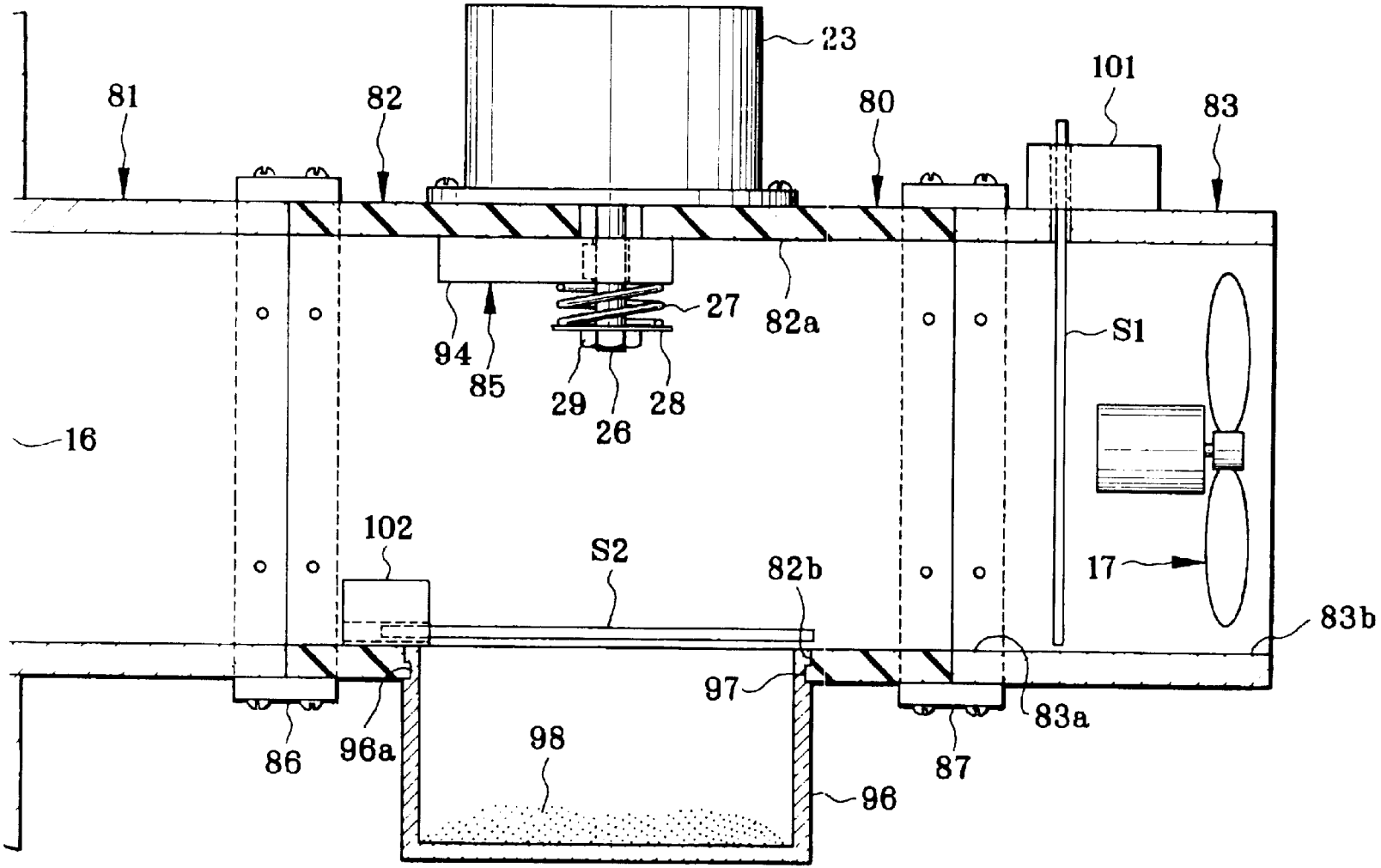
FIG. 8 is a vertical section illustrating a further preferred dust collector in which an electrostatic generator unit is located in the upside.

In FIG. 8, a further preferred dust collector 80 is illustrated. A passage case of the dust collector 80 includes an upstream casing frame 81, an intermediate casing frame 82 and a downstream casing frame 83. The upstream casing frame 81 contains the filter 16. There is an electrostatic generator unit 85 incorporated in the intermediate casing frame 82. The downstream casing frame 83 contains the fan 17. There are connection frames 86 and 87 for securing the upstream casing frame 81 and the downstream casing frame 83 to the intermediate casing frame 82 with screws. A combination of the upstream casing frame 81, the intermediate casing frame 82 and the downstream casing frame 83 is the passage case in a quadrilateral prism. The screws on the connection frames 86 and 87 can be unfastened. Thus, the intermediate casing frame 82 can be removed from the dust collector 80 and cleaned easily. Note that there is an air intake port 81*a* through which external air is taken in. An air exhaust port 83*b* lets the air out.

The electrostatic generator unit 85 includes the intermediate casing frame 82, a rotatable friction disk 94 as second friction device, and the motor 23. The intermediate casing frame 82 operates as first friction device, and constitutes both of the first friction disk 21 and the case panel 24 according to the initial embodiment. The friction disk 94 is biased by the coil spring 27 toward the intermediate casing frame 82 in the same manner as the second friction disk 22. Force of the bias of the coil spring 27 to the friction disk 94 is adjusted by the nut 29 to change the position of the flange ring 28 at the motor output shaft 26 of the motor 23.

Figure 9:
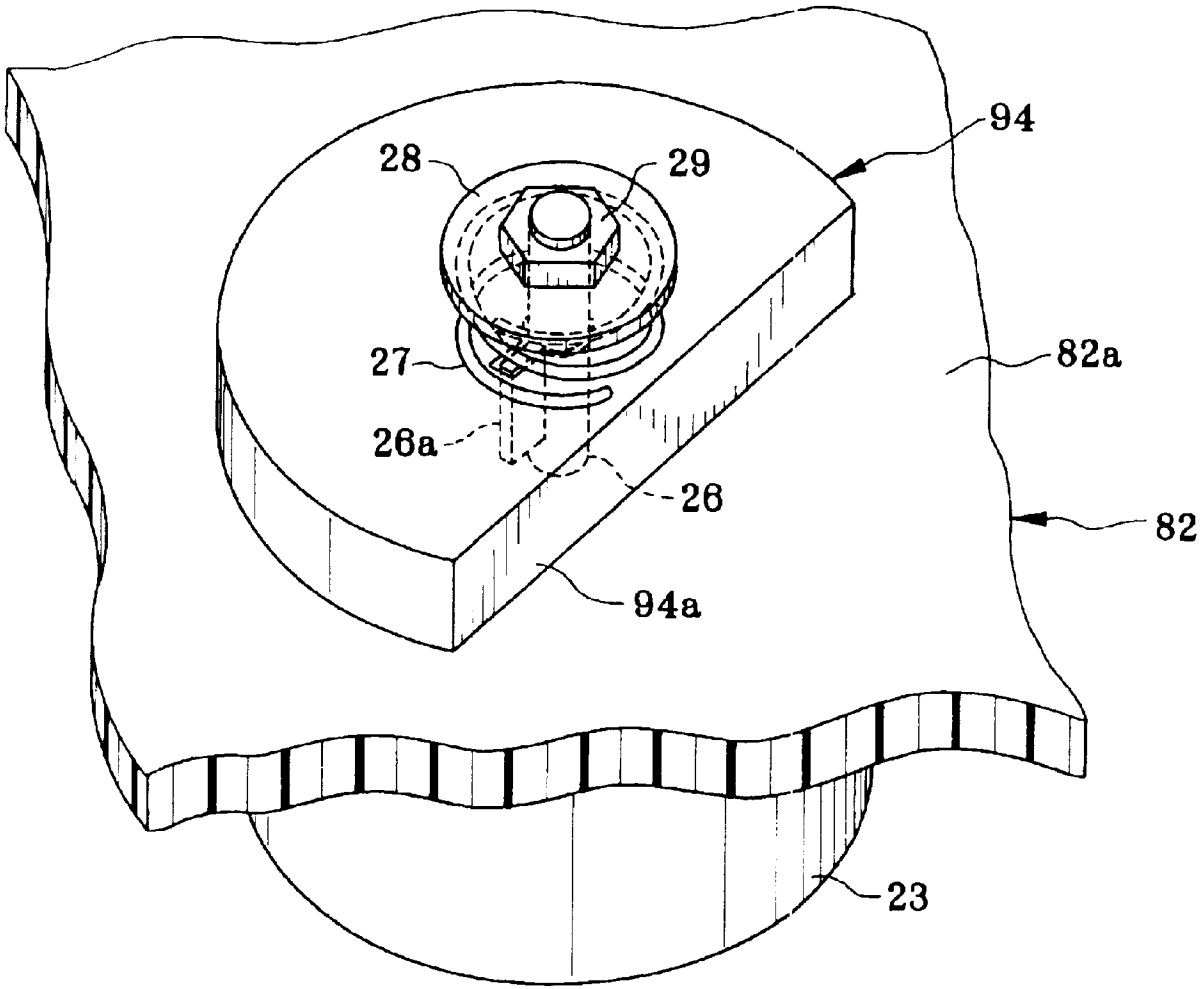
FIG. 9 is a perspective, partially broken, illustrating the electrostatic generator unit.

The intermediate casing frame 82 is formed from polytetrafluoroethylene or Teflon (trade name), and has a surface resistance of $10^9$ Ω or more. Each of the upstream casing frame 81 and the downstream casing frame 83 has a surface resistance of $10^9$ Ω or less. The friction disk 94 is formed from polypropylene, and has nearly a semi-circular shape. See FIG. 9. An inner surface 82*a* of the intermediate casing frame 82 is rubbed by the friction disk 94 rotated by the motor 23. Then the friction disk 94 is charged positively. The intermediate casing frame 82 is charged negatively. However, there is nearly no electrical charging of the upstream casing frame 81 and the downstream casing frame 83.

Among dust particles in the air taken in the intermediate casing frame 82, the positively charged floating fine particles 31 are attracted by the intermediate casing frame 82. The negatively charged floating fine particles 32 are attracted by the friction disk 94. At the same time, a dust eliminating edge portion 94*a* of the friction disk 94 in the straight shape rubs away the positively charged floating fine particles 31 lying on the inner surface 82*a* of the intermediate casing frame 82 in the course of rotations of the friction disk 94.

The electrostatic generator unit 85 is disposed on the upside of the intermediate casing frame 82. A dust exit path 82*b* is formed in the underside of the intermediate casing frame 82. A dust containing case 96 is secured to the periphery of the dust exit path 82*b* in a removable manner. The dust containing case 96 is formed from plastic material having flexibility. A groove 96*a* is formed on edges of the dust containing case 96. A ridge 97 projects from edges of the dust exit path 82*b*, and is engaged with the groove 96*a* for keeping the dust containing case 96 positioned at the dust exit path 82*b* of the intermediate casing frame 82.

Particles or fine dust 98 is rubbed away from the inner surface 82*a* of the intermediate casing frame 82 by the dust eliminating edge portion 94*a* of the friction disk 94, and drops and deposits in the dust containing case 96. Then the dust containing case 96 is removed from the dust exit path 82*b* to discard all the fine dust 98 out of the dust containing case 96. This can be performed periodically, for example one time per a month. The inside of the intermediate casing frame 82 can be kept clean readily for normal operation of the air cleaning without need of disassembly all of the passage case of the dust collector 80.

A portion of the intermediate casing frame 82 being charged electrically is mainly located as a part of the inner surface 82*a* directly rubbed on the friction disk 94. A potential of the charging decreases according to a distance from the portion with the highest potential. Accordingly, there is no occurrence of entire pollution of the inner surface 82*a* with dust in the intermediate casing frame 82. Note that dust is also stuck on the surface of the friction disk 94. However, it is likely that the dust does not drop from the friction disk 94 easily. For the purpose of clearing dust from the friction disk 94, the dust collector 80 is periodically disassembled and cleaned, for example one time per six months. Alternatively, the friction disk 94 can be renewed periodically.

A shutter plate S1 is incorporated in the downstream casing frame 83 in a movable manner. A path or opening 83*a* of the downstream casing frame 83 on the side of the intermediate casing frame 82 is openably closed by the shutter plate S1. A shutter drive device 101 is disposed on an upside of the downstream casing frame 83, and drives the shutter plate S1. A shutter plate S2 is incorporated in the intermediate casing frame 82 in a movable manner. The dust exit path 82*b* of the intermediate casing frame 82 is openably closed by the shutter plate S2. A shutter drive device 102 is disposed beside the intermediate casing frame 82, and drives the shutter plate S2. The shutter plates S1 and S2 are opened and closed in an alternate manner, which will be described later in detail.

Figure 10:
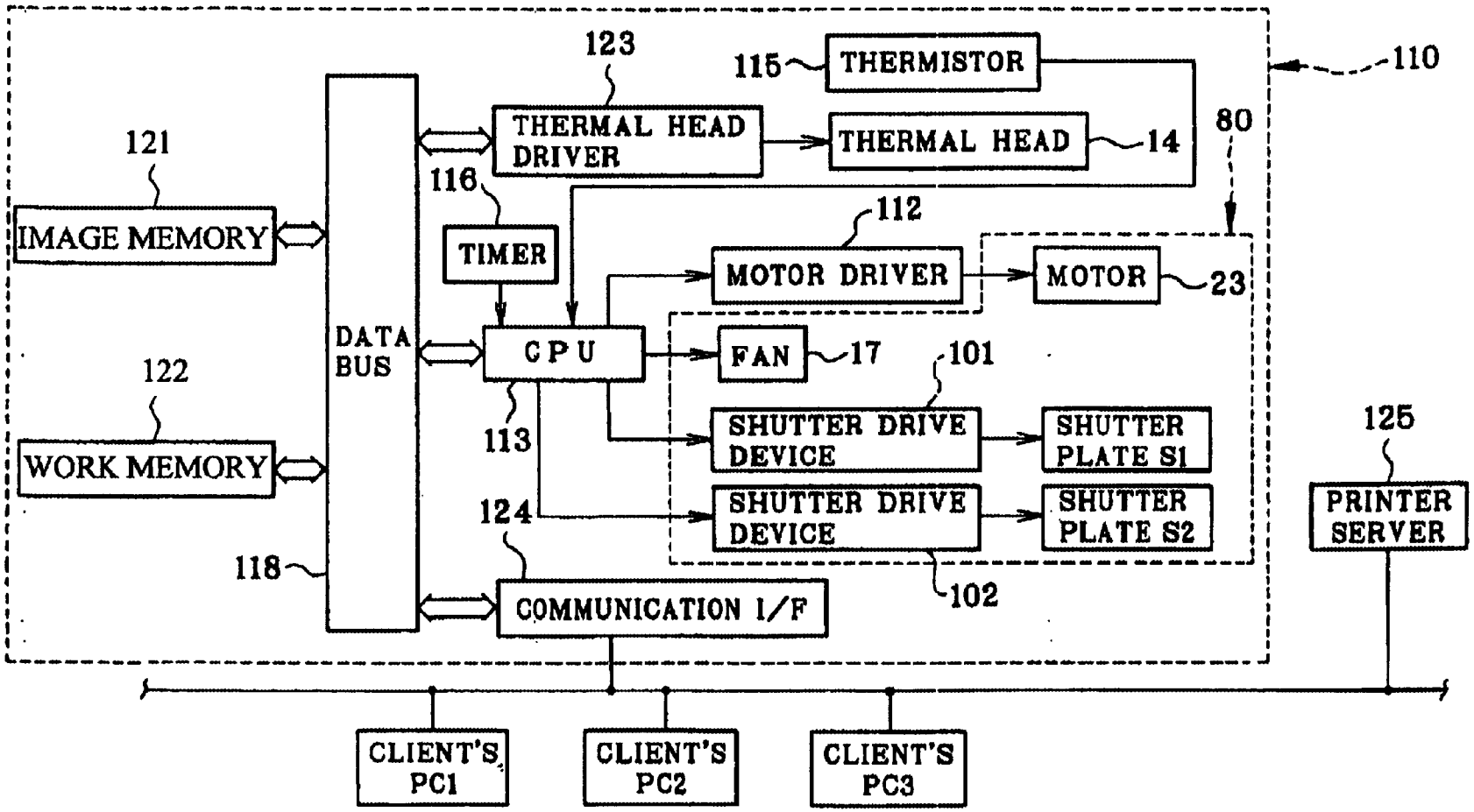
FIG. 10 is a block diagram schematically illustrating thermal printer with the electrostatic generator unit.

In FIG. 10, a circuit arrangement of a thermal printer 110 provided with the dust collector 80 is illustrated. A motor driver 112 is connected with the motor 23 in the dust collector 80. A CPU 113 as controller causes the motor driver 112 to rotate the motor 23. CPU 113 also controls the fan 17 of the dust collector 80, and the shutter drive devices 101 and 102. A thermistor 115 is associated with the thermal head 14, obtains data of the temperature of the thermal head 14, and sends the temperature data to CPU 113. The thermal printer 110 includes elements similar to those in the embodiment of FIG. 6. Such elements are herein designated with identical reference numerals.

A timer 116 is connected with CPU 113. The timer 116 measures elapsed time T elapsed after the stop of the electrostatic generator unit 85. Even after the electrostatic generator unit 85 stops operation, potential of the intermediate casing frame 82 and the friction disk 94 being charged remains at a sufficiently high level for collecting dust effectively for a predetermined time, for example 10 minutes. During the period of the 10 minutes, the electrostatic generator unit 85 remains stopped. After the 10 minutes, CPU 113 causes the shutter drive device 101 to close the shutter plate S1 to stop the air from flowing; The shutter drive device 102 is driven to open the shutter plate S2, before CPU 113 rotates the motor 23 to drive the electrostatic generator unit 85. Thus, the intermediate casing frame 8Z and the friction disk 94 are caused to generate electrostatic charge. When the shutter plate S1 is closed, the fan 17 is stopped.

When the electrostatic generator unit 85 starts being driven, the friction disk 94 is charged positively. The intermediate casing frame 82 is charged negatively. The fine dust 98 flowing in the air inside the upstream casing frame 81 and the intermediate casing frame 82 is collected by the surfaces of the intermediate casing frame 82 and the friction disk 94. The dust eliminating edge portion 94*a* of the friction disk 94 rubs the dust away from the inner surface 82*a* of the intermediate casing frame 82. As the shutter plate S1 is closed to stop the flow of the air, the dust drops down from the inner surface 82*a* in a nearly vertical manner, and comes into the dust containing case 96. Therefore, no pollution with dust occurs inside the upstream casing frame 81, because dust is collected inside the dust containing case 96.

The electrostatic generator unit 85 is driven for a predetermined driving time, for example 5 minutes to charge the intermediate casing frame 82 and the friction disk 94 sufficiently. After the lapse of this driving time, the motor 23 is stopped. The shutter plate S2 is closed. Also, the shutter plate S1 is opened. The fan 17 restarts being driven. Even when the electrostatic generator unit 85 is stopped, the charged state of the intermediate casing frame 82 and the friction disk 94 can be maintained for approximately 10 minutes. Dust in the air taken in through the filter 16 is collected by the surfaces of the intermediate casing frame 82 and the friction disk 94. The air is cleaned and sent to the thermal head 14 through the duct 13. Note that the sequence of those steps is repeated while the power source of the thermal printer 110 is turned on.

The thermal printer 110 also includes an image memory 121, a work memory 122, a thermal head driver 123 and a communication interface (I/F) 124, which are connected with CPU 113 by a data bus 118. The image memory 121 stores image data of an image obtained from a digital camera or the like. The work memory 122 is used by CPU 113 in operation of subjecting the image data to processing of various corrections or changes.

The communication interface 124 is connected with clients' personal computer PC1, PC2, PC3 and so on, and a printer server 125 which is constituted by a local area network (LAN). If an instruction signal for printing is input from any one of the personal computer PC1, PC2, PC3 and so on, the printer server 125 causes the communication interface 124 to input a printing command signal to the thermal printer 110.

Figure 11:
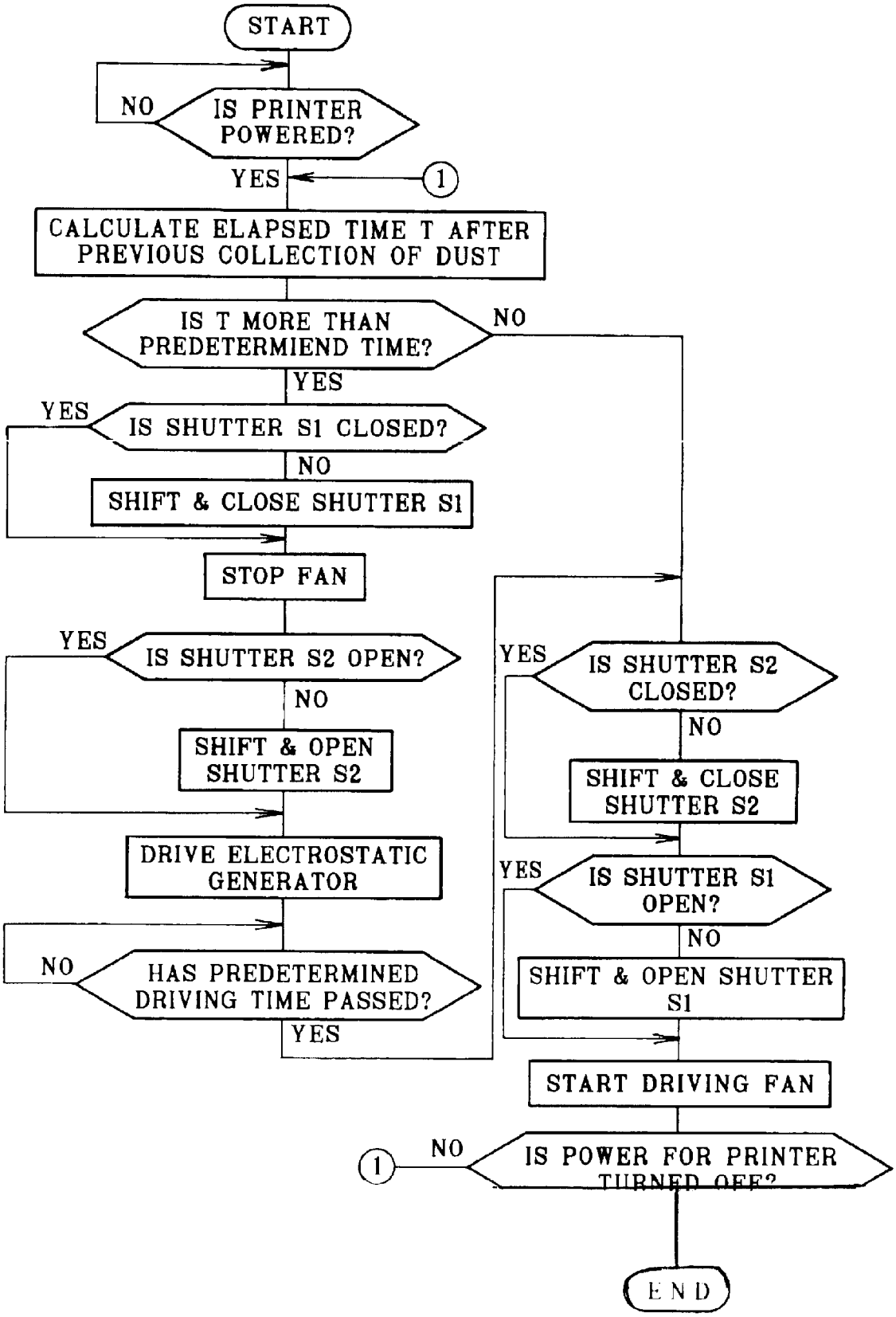
FIG. 11 is a flow chart illustrating a sequence of the operation of the dust collector.

The operation of the above-constructed embodiment is described with reference to a flow chart of FIG. 11. While the thermal printer 110 is not powered, the shutter plate S1 of the dust collector 80 is closed. The shutter plate S2 is open. When a power source for the thermal printer 110 is turned on, CPU 113 refers to a counted number that is information generated by the timer 116, and calculates elapsed time T elapsed after the previous stop of operation of the electrostatic generator unit 85. It is checked whether the elapsed time T has come up to 10 minutes.

If the thermal printer 110 is powered initially at the very beginning of operation in one day, the elapsed time T is 10 minutes or more. Then it is checked that the shutter plate S1 is closed and that the shutter plate S2 is opened. After this, the motor 23 starts being driven. The friction disk 94 rotates, to cause its contact surface to rub the inner surface 82*a* of the intermediate casing frame 82. The intermediate casing frame 82 is charged negatively. The friction disk 94 is charged positively. Among particles of dust in the air in the upstream casing frame 81 and the intermediate casing frame 82, the positively charged floating fine particles 31 are attracted by the intermediate casing frame 82. The negatively charged floating fine particles 32 are attracted by the friction disk 94.

At the same time as collection of the fine dust 98, the dust eliminating edge portion 94*a* in the electrostatic generator unit 85 rubs away the fine dust 98 from the inner surface 82*a* of the intermediate casing frame 82. The fine dust 98 drops to the inside of the dust containing case 96. The shutter plate S1 has been closed to stop the flow of the air. The fine dust 98 drops nearly vertically under the gravity, and does not scatter outside an area covered by the dust containing case 96.

CPU 113 refers to the counted number as a signal output by the timer 116. When five minutes elapse after the start of the dust collecting operation. CPU 113 stops driving the motor 23. The shutter drive devices 101 and 102 are operated to close the shutter plate S2 and open the shutter plate 81. After this, the fan 17 starts being driven, and sends cooling air through the duct 13 to the thermal head 14. During the operation of sending the cooling air, the friction disk 94 and the intermediate casing frame 82 remain at the sufficient potential obtained by charging for the dust collection. The dust collection of the friction disk 94 and the intermediate casing frame 82 continues, so that cleaned cooling air can be sent to the thermal head 14 continuously.

When 10 minutes pass after the stop of operation of the electrostatic generator unit 85, the shutter plate Si is closed, The shutter plate S2 is opened, to drive the electrostatic generator unit 85. The sequence of those processes is repeated while the thermal printer 110 is powered.

The thermal head 14 is incessantly cooled. However, it data of temperature of the thermal head 14 input by the thermistor 115 to CPU 113 should become equal to or higher than a predetermined level, operation of the electrostatic generator unit 85 is stopped forcibly even during the step of a normal rotation. The shutter plate S2 is closed. The shutter plate S1 is opened. The fan 17 is driven to send cooling air to the thermal head 14. The printing operation of the thermal printer 110 is the same as that according to the above-described initial embodiment.

The dust containing case 96 is removed from the dust exit path 82*b* periodically, for example one time per a month, to discard the fine dust 98 in a cumulative manner. Note that a sensor may be used for monitoring an amount of the fine dust 98 in the dust containing case 96 or the intermediate casing frame 82. A buzzer or other alarming device may be driven for generating an acoustic signal when an amount of the fine dust 98 comes up to a predetermined high level. Furthermore, a display panel of LCD may be used in a printer body to display an indication of letters, indicia or the like. A user can be informed of an alarm state by the acoustic signal or the visible indication, and manually remove the dust containing case 96 from the dust exit path 82*b* to discard the fine dust 98. This makes it unnecessary to check the fine dust 98 periodically.

At each time that a predetermined period elapses, for example six months, the screws on the connection frames 86 and 87 are unfastened to disassemble the dust collector 80 into the three pieces including the upstream casing frame 81, the intermediate casing frame 82 and the downstream casing frame 83. The inner surface 82*a* and the friction disk 94 are cleaned in a step included in a periodical maintenance. If the dirt stuck on the friction disk 94 is excessive and not recoverable, the friction disk 94 is replaced with an unused one.

Figure 12:
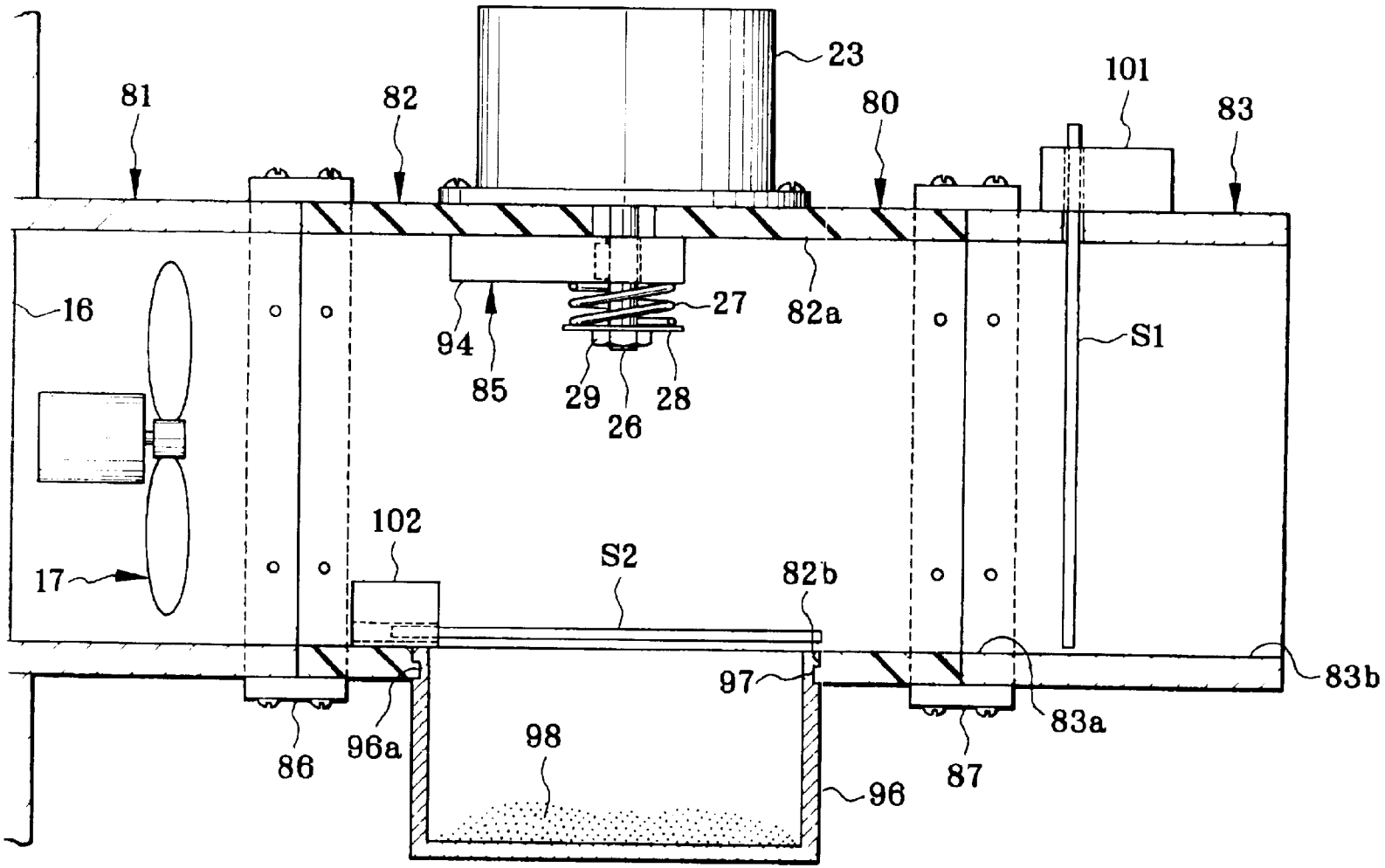
FIG. 12 is a vertical section illustrating another dust collector in which a fan is disposed near to an air intake port.

In the present embodiment, the fan 17 is disposed inside the downstream casing frame 83 having the air exhaust port 83*b* of the dust collector 80. Alternatively, the fan 17 may be positioned in the manner of FIG. 12, namely disposed in the upstream casing frame 81 having the air intake port 81*a*. In this construction, the shutter plate S1 may be disposed in the downstream casing frame 83, but can be disposed in the upstream casing frame 81 associated with the fan 17.

Figure 13:
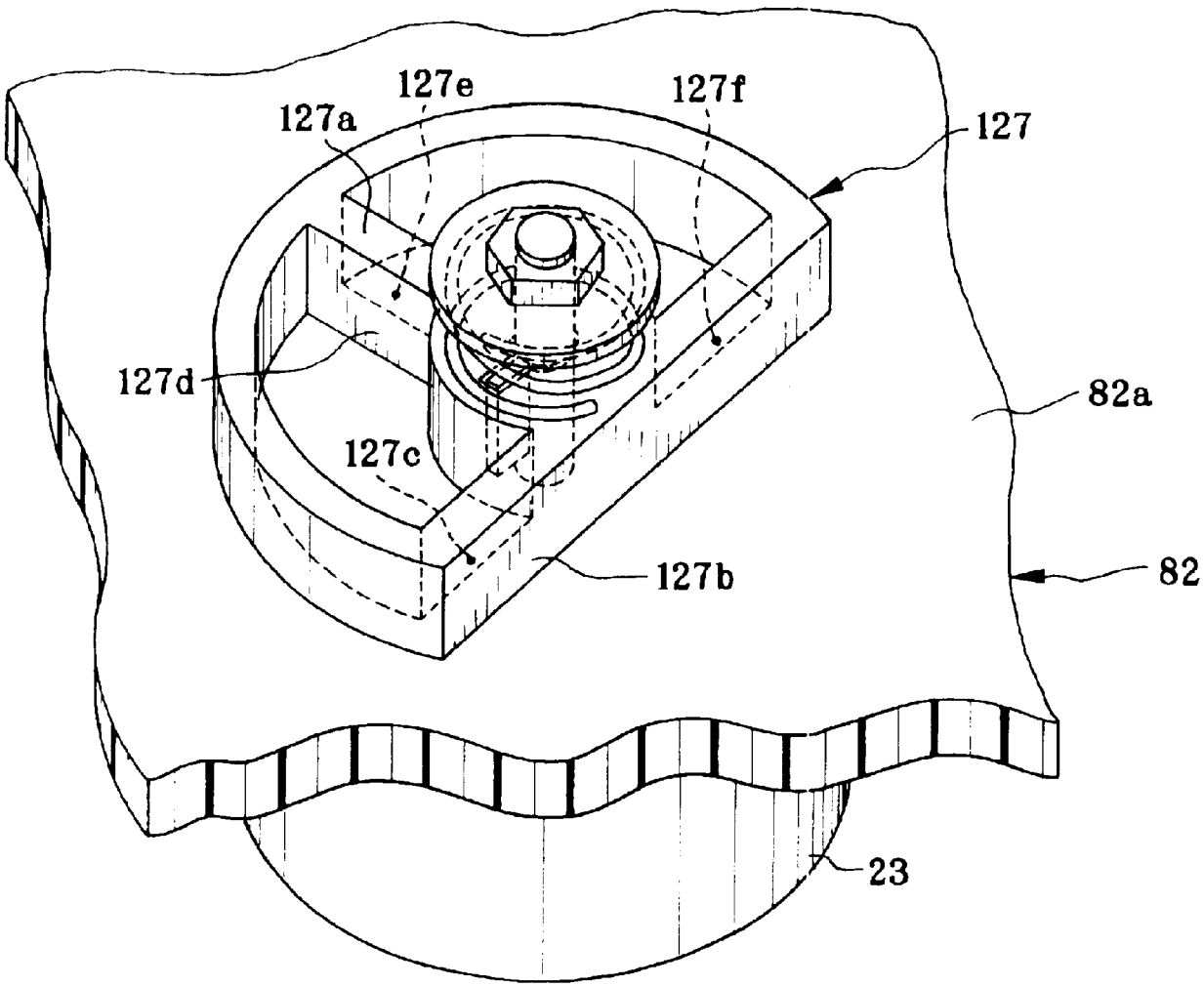
FIG. 13 is a perspective, partially broken, illustrating a friction plate according to another preferred embodiment, in which dust eliminating edge portions are formed by forming openings.

In the above embodiment, the friction disk 94 in the electrostatic generator unit has a shape slightly greater than a semi-circle. Alternatively, a rotatable friction ring 127 as second friction device in FIG. 13 may be used. The friction ring 127 has such a shape that openings are formed in the friction disk 94 and that a rotational central portion 127*a* is defined between the openings. Consequently, five dust eliminating edge portions 127*b*–127*f* are provided in the friction ring 127 in the number higher than the one edge portion 94*a* of the friction disk 94. Note that the friction ring 127 rotates in one direction. So three of the dust eliminating edge portions 127*b*–127*f* are effective in rubbing dust away.

Figure 14:
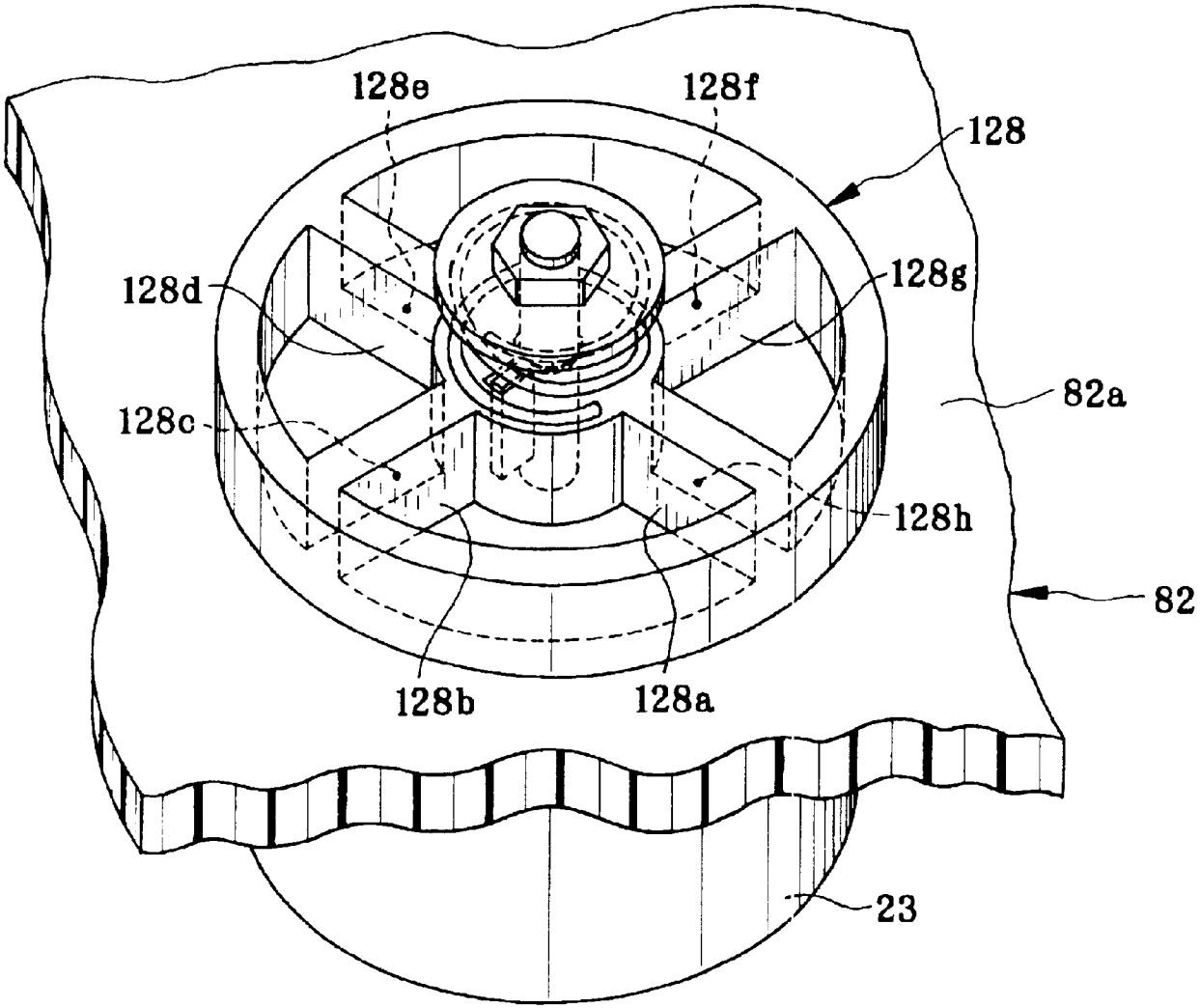
FIG. 14 is a perspective, partially broken, illustrating a friction disk according to still another preferred embodiment, which is circular and in which dust eliminating edge portions are formed.

In FIG. 14, another preferred rotatable friction ring 128 as second friction device is illustrated. The friction ring 128 has four openings formed in a disk. The openings define eight dust eliminating edge portions 128*a*–128*h* in a straight form for efficiently rubbing dust away. Note that the friction ring 128 rotates in one direction. So four of the dust eliminating edge portions 128*a*–128*h* are effective in rubbing dust away.

Figure 15:
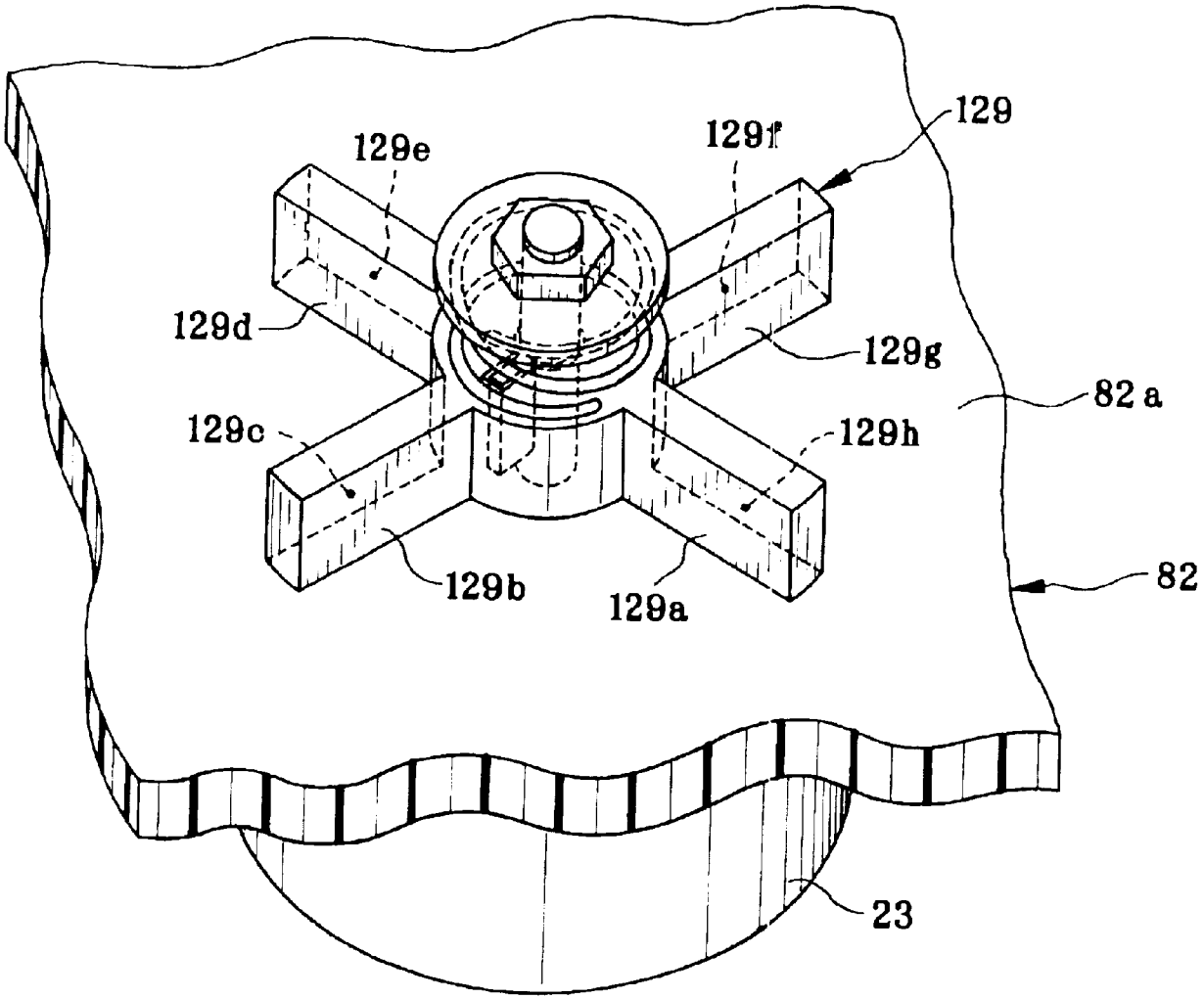
FIG. 15 is a perspective, partially broken, illustrating a friction member according to another preferred embodiment, which is cross-shaped.

In FIG. 15, another preferred rotatable friction member 129 as second friction device is depicted. The friction member 129 has a cross shape, or has a shape obtained by eliminating a ring portion from the friction ring 128. Eight dust eliminating edge portions 129*a*–129*h* are defined in the friction member 129, and can rub dust away efficiently. Note that the friction member 129 rotates in one direction. So four of the dust eliminating edge portions 129*a*–129*h* are effective in rubbing dust away. In the friction member 129, an area of contacting the inner surface 82*a* of the intermediate casing frame 82 is smaller than that of the friction ring 128. Although an effect of electrostatic charge being generated is smaller than the friction ring 128, the friction member 129 has its advantage in that peripheral openness of the friction member 129 created by eliminating the ring portion makes it possible to move dust away radially from the friction member 129.

It is to be noted that a movable friction device can have a shape other than those depicted in FIGS. 9, 13, 14 and 15. A movable friction device can have any suitable shape or structure that can frictionally contact the stationary friction device or the intermediate casing frame 82 and can rub dust away from it.

In the above embodiments, Teflon (trade name) and polypropylene are selected as substances for contacting each other frictionally to generate charge. However, two different substances of any suitable combination can be selected in positions in the triboelectric series of substances. However, it is known that an effect of charging by frictional contact of two substances in the triboelectric series is lower according to closeness between those in the triboelectric series. So it is necessary that two substances to be selected should be in positions sufficiently distant from each other within the triboelectric series. In the first of the preferred embodiments herein, the first friction disk 21 of Teflon (trade name) is fixed on the case panel 24 by use of the screws. However, a tape of Teflon (trade name) may be used, and attached to the case panel 24 in a fixed manner.

In the above embodiments, the second friction disk 22, the friction disk 94, the friction rings 127 and 128 and the friction member 129 are formed from polypropylene, and is movable. The first friction disk 21 and the intermediate casing frame 82 are formed from Teflon, and is stationary.

However, a movable friction device may formed from Teflon. A stationary friction device may be formed from polypropylene.

In the initial one of the above embodiments, the first friction disk 21 stationary in the passage case 15 is in a circular shape. However, the first friction disk 21 may be replaced by a plate of a quadrilateral or other form. In the above embodiments, the flat contact surfaces of the first and second friction devices are contacted on each other in a face-to-face manner. However, a combination of the first and second friction devices may be two rollers, or a roller and a flat surface, or the like. In the above embodiments, the second friction disk 22, the friction disk 94, the friction rings 127 and 128 and the friction member 129 as second friction device are rotatable. However, a second friction device may be movable back and forth in a straight manner for rubbing a first friction device kept stationary. In the above embodiments, the electrostatic generator units 18, 61, 62, 85 are disposed on the upper panel or the lower panel. However, the electrostatic generator units 18, 61, 62, 85 may be disposed on any one of lateral panels of the passage case 15, 72 or the intermediate casing frame 82 which extend vertically.

In the initial preferred embodiment, the electrostatic generator unit 18 is disposed in the downside of the passage case 15. However, the electrostatic generator unit 18 may be disposed in the upside of the passage case 15. The dust containing case 96 similar to that of the third embodiment may be disposed in the downside of the passage case 15. In the above embodiments, the dust containing case 96 has a box shape. However, the dust containing case 96 can have a semi-spherical shape for the purpose of receiving the fine dust 98. In the third of the embodiments, the upstream casing frame S1, the intermediate casing frame 82 and the downstream casing frame 83 are connected one another by the connection frames 86 and 87. However, any fastening structure may be used for connecting the upstream casing frame 81, the intermediate casing frame 82 and the downstream casing frame 83. The upstream casing frame 81, the intermediate casing frame 82 and the downstream casing frame 83 may be connected in a manually removable manner, for example by engagement of ridges and grooves. Furthermore, those may be connected by clips, clamps, or other fastening devices for fastening in a manually detachable manner. In the above embodiments, the electrostatic generator unit 18, 61, 62, 85 is disposed between the filter 16 and the fan 17. However, the fan 17 can be disposed sear to the filter 16. See FIG. 12. The electrostatic generator unit 18, 61, 62, 85 may be positioned downstream from the fan 17.

In the third of the above preferred embodiments, the driving time of the electrostatic generator unit 85 is set five minutes. The air supply time for supply cooling air to the thermal head 14 is set 10 minutes. The period of discarding the fine dust 98 from the dust containing case 96 is set one month. The period of disassembly and cleaning of the dust collector 80 is set six months. However, any of those values can be changed as required In the third of the embodiments, the motor 23, the fan 17, and the shutter plates S1 and S2 are controlled by CPU 113 in the thermal printer 110. However, a control unit may be incorporated in the dust collector 80 for controlling those elements without being controlled by the thermal printer 110. It is preferable to control the dust collector 80 to administrate the temperature of the thermal head 14 precisely. To this end, CPU 113 of the thermal printer 110 should be preferably connected with the control unit of the dust collector 80 by a communication system, which enables total control of the combination of the dust collector 80 and the thermal printer 110.

All of the above-described dust collectors are used in the thermal printer. However, a dust collector or air cleaner according to the invention may be used with devices for any purpose.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A dust collector for collecting fine dust in air and for cleaning said air, comprising:

a first friction member produced from a first substance;

a second friction member produced from a second substance that is chargeable triboelectrically in a polarity different from a polarity of said first substance;

a friction driving mechanism which moves one of said first and second friction members relative to a remaining one thereof, and which frictionally generates electrostatic charge, to attract said fine dust and attendantly provide clean air for a cooling function;

a passage case for defining a path of said air, having an air intake port and an air exhaust port, wherein said first and second friction members are disposed between said air intake port and said air exhaust port and overlapped with one another; and a fan for flowing of said air in said passage case, wherein said first or second friction member attracts said fine dust electrostatically while said air flows in said passage case.

2. A dust collector as defined in claim 1, wherein said first substance is polytetrafluoroethylene.

3. A dust collector as defined in claim 1, wherein at least one of said first and second substances has a surface resistance of $10^9$ Ω or higher.

4. A dust collector as defined in claim 1, further comprising a filter disposed close to said air intake port.

5. A dust collector as defined in claim 4, wherein said air intake port lets in said air from an outside of an instrument, and said air exhaust port ejects said air to blow and cool a heat generating portion of said instrument.

6. A dust collector as defined in claim 5, wherein said instrument is a thermal printer, and said heat generating portion is a thermal head.

7. A dust collector as defined in claim 4, wherein said first friction member is stationary in said passage case, said second friction member is uncovered in said path inside said passage case;

said driving mechanism rotates said second friction member.

8. A dust collector as defined in claim 7, wherein said first and second substances have such characteristics as to be charged respectively in negative and positive states when frictionally contacted on one another.

9. A dust collector as defined in claim 7, wherein said driving mechanism includes:

a rotational shaft for rotating said second friction member, said rotational shaft being slidable relative to said second friction member, and inserted loosely in said first friction member;

a motor for rotating said rotational shaft; and a bias mechanism for pressing said second friction member against said first friction member.

10. A dust collector as defined in claim 9, wherein said first friction member is plate-shaped, and said second friction member is disk-shaped, or substantially semi-circular and plate-shaped, or cross-shaped.

11. A dust collector as defined in claim 9, wherein said rotational shaft includes a flange, disposed on a portion thereof inserted through said second friction member, and said bias mechanism is disposed between said flange and said second friction member.

12. A dust collector as defined in claim 11, wherein said passage case includes;

an opening; and a first case panel, secured to an inside of said opening in a removable manner, having an inner surface to which said first friction member is secured fixedly, having an outer surface to which said motor is secured fixedly, and having a hole through which said rotational shaft extends.

13. A dust collector as defined in claim 12, wherein said passage case has a box shape, having upper and lower panels, said first case panel is associated with said upper panel;

further comprising:

a second case panel associated with said lower panel;

a third friction member secured to said second case panel; and a fourth friction member for contacting said third friction member, for being rotated by said rotational shaft, to charge triboelectrically with said third friction member.

14. A dust collector as defined in claim 11, wherein said passage case includes an opening for securing of said first friction member thereto in a removable manner, said first friction member has an inner surface on which said second friction member is disposed, and has an outer surface to which said motor is secured fixedly.

15. A dust collector as defined in claim 9, further comprising a dust eliminating portion for rubbing away said fine dust stuck on said first or second friction member.

16. A dust collector as defined in claim 15, wherein said dust eliminating portion is constituted by an edge portion of said second friction member extending crosswise to a rotational direction, for rubbing away said fine dust from said first friction member upon rotation of said second friction member.

17. A dust collector as defined in claim 16, wherein said first and second friction members are disposed at an upper panel of said passage case disposed on an upside;

further comprising a container, disposed under said passage case, for receiving said fine dust being rubbed away.

18. A dust collector as defined in claim 17, wherein said passage case includes:

an intermediate casing frame provided with said first and second friction members and said container;

an upstream casing frame, connected with said intermediate casing frame on an upstream side, for containing said filter; and a downstream casing frame, connected with said intermediate casing frame on a downstream side, for containing said fan.

19. A dust collector as defined in claim 18, further comprising:

a first shutter for closing said path of said air openably;

a second shutter for closing a passage port of said container openably;

a controller for setting an alternately selected one of first and second shutter modes, wherein said controller, while said first shutter mode is set, closes said second shutter and opens said first shutter, and drives said fan to eject said air from said passage case, and while said second shutter mode is set, closes said first shutter and opens said second shutter, and actuates said driving mechanism to attract said fine dust.

20. A dust collector as defined in claim 19, wherein said controller sets said first shutter mode while said first and second friction members remain electrostatically charged sufficiently for attracting said fine dust, and sets said second shutter mode while said first and second friction members become electrostatically charged at a predetermined level.

21. A dust collector as defined in claim 20, wherein a surface resistance of said intermediate casing frame is higher than a surface resistance of said upstream and downstream casing frames, and is $10^9$ Ω or higher.

22. A dust collector as defined in claim 19, wherein said second friction member is D-shaped.

23. A dust collector as defined in claim 19, wherein said second friction member includes a plurality of openings having a sector shape.

24. A dust collector as defined in claim 19, wherein said second friction member includes a plurality of arm portions extending in different directions from a rotational axis, and a ring portion for connecting ends of said arm portions.

25. A dust collector as defined in claim 20, wherein said second friction member includes a plurality of arm portions extending in different directions from a rotational axis.

26. A dust collector for collecting fine dust in air and for cleaning said air, comprising:

a first friction member produced from a first substance;

a second friction member produced from a second substance that is chargeable triboelectrically in a polarity different from a polarity of said first substance;

a friction driving mechanism for moving one of said first and second friction members relative to a remaining one thereof and for frictionally generating electrostatic charge, including:

a rotational shaft including a flange disposed on a portion thereof inserted through said second friction member, said rotational shaft being slidable relative to said second friction member and inserted loosely in said first friction member;

a motor for rotating said rotational shaft; and a bias mechanism disposed between said flange and said second friction member and for pressing said second friction member against said first friction member;

wherein said driving mechanism rotates said second friction member;

a passage case for defining a path of said air, having an air intake port and an air exhaust port, wherein said first and second friction members are disposed between said air intake port and said air exhaust port and overlapped with one another;

a fan for flowing of said air in said passage case, wherein said first or second friction member attracts said fine dust electrostatically while said air flows in said passage case and wherein said first friction member is stationary in said passage case and said second friction member is uncovered in said path inside said passage case; and a filter disposed close to said air intake port.

27. A dust collector for collecting fine dust in air and for cleaning said air, comprising:

a first friction member produced from a first substance;

a second friction member produced from a second substance that is chargeable triboelectrically in a polarity different from a polarity of said first substance;

a friction driving mechanism for moving one of said first and second friction members relative to a remaining one thereof and for frictionally generating electrostatic charge, including:

a rotational shaft for rotating said second friction member, said rotational shaft being slidable relative to said second friction member and inserted loosely in said first friction member;

a motor for rotating said rotational shaft; and a bias mechanism for pressing said second friction member against said first friction member;

a passage case for defining a path of said air, having an air intake port and an air exhaust port, wherein said first and second friction members are disposed between said air intake port and said air exhaust port and overlapped with one another;

a fan for flowing of said air in said passage case, wherein said first or second friction member attracts said fine dust electrostatically while said air flows in said passage case and wherein said first friction member is stationary in said passage case and said second friction member is uncovered in said path inside said passage case;

a filter disposed close to said air intake port; and a dust eliminating portion for rubbing away said fine dust stuck on said first or second friction member, wherein said dust eliminating portion is constituted by an edge portion of said second friction member extending crosswise to a rotational direction and for rubbing away said fine dust from said first friction member upon rotation of said second friction member.

* * * * *